US011885547B2

(12) United States Patent
Chung et al.

(10) Patent No.: US 11,885,547 B2
(45) Date of Patent: Jan. 30, 2024

(54) REFRIGERATOR HAVING A COLD AIR SUPPLY MEANS AND CONTROL METHOD THEREFORE

(71) Applicant: LG ELECTRONICS INC., Seoul (KR)

(72) Inventors: Myungjin Chung, Seoul (KR); Kyeongyun Kim, Seoul (KR); Kyungseok Kim, Seoul (KR); Soyoon Kim, Seoul (KR); Seunguk Ahn, Seoul (KR); Kyunghun Cha, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/078,608

(22) Filed: Dec. 9, 2022

(65) Prior Publication Data

US 2023/0114081 A1 Apr. 13, 2023

Related U.S. Application Data

(63) Continuation of application No. 17/148,379, filed on Jan. 13, 2021, now Pat. No. 11,549,736, which is a (Continued)

(30) Foreign Application Priority Data

Dec. 15, 2015 (KR) ..... 10-2015-0179493
Nov. 30, 2016 (KR) ..... 10-2016-0161285

(51) Int. Cl.
*F25D 29/00* (2006.01)
*F25B 49/02* (2006.01)
(Continued)

(52) U.S. Cl.
CPC ..... *F25B 49/022* (2013.01); *F25B 49/02* (2013.01); *F25D 17/045* (2013.01); *F25D 17/06* (2013.01);
(Continued)

(58) Field of Classification Search
CPC ..... F25B 49/02; F25B 49/022; F25B 49/025; F25B 2500/04; F25B 2600/00;
(Continued)

(56) References Cited

U.S. PATENT DOCUMENTS 5,809,790 A 9/1998 Kwon
5,983,653 A 11/1999 Lee
(Continued)

FOREIGN PATENT DOCUMENTS

CN 1186211 7/1998
CN 1186213 7/1998
(Continued)

OTHER PUBLICATIONS

Extended European Search Report dated Nov. 3, 2022 issued in Application No. 22172086.5.
(Continued)

*Primary Examiner* — Jonathan Bradford
(74) *Attorney, Agent, or Firm* — KED & ASSOCIATES, LLP

(57) ABSTRACT

A control method for a refrigerator includes sensing a temperature of a storage room; operating a cool air supply at a cooling power when the sensed temperature of the storage room is equal to or above a first reference temperature; operating the cool air supply at a delay power, which is less than the cooling power, when the sensed temperature of the storage room is equal to or below a second reference temperature, which is less than the first reference temperature while the cool air supply is operating at the cooling
(Continued)

power; and adjusting the cooling power or the delay power of the cool air supply according to the temperature of the storage room while the cool air supply is operating at the delay power, and operating the cool air supply at the determined adjusted cooling power or delay power.

20 Claims, 13 Drawing Sheets

Related U.S. Application Data continuation of application No. 15/780,587, filed as application No. PCT/KR2016/014555 on Dec. 12, 2016, now Pat. No. 10,941,969.

(51) Int. Cl.
*F25D 17/06* (2006.01)
*F25D 19/00* (2006.01)
*F25D 17/04* (2006.01)

(52) U.S. Cl.
CPC ..... *F25D 19/00* (2013.01); *F25D 29/00* (2013.01); *F25B 2500/11* (2013.01); *F25B 2600/0253* (2013.01); *F25B 2700/151* (2013.01); *F25B 2700/2104* (2013.01); *F25D 2500/04* (2013.01); *F25D 2700/12* (2013.01)

(58) Field of Classification Search
CPC ..... F25B 2600/0253; F25B 2600/12; F25B 2600/04; F25B 2600/06; F25B 2700/151; F25B 2700/2104; F25D 17/045; F25D 17/06; F25D 17/067; F25D 19/00; F25D 29/00; F25D 2700/12; F25D 2700/121; F25D 2700/122; F25D 2700/123
See application file for complete search history.

(56) References Cited

U.S. PATENT DOCUMENTS

| | | | |
|---|---|---|---|
| 6,725,680 | B1 | 4/2004 | Schenk et al. |
| 7,730,732 | B2 | 6/2010 | Kaga et al. |
| 8,499,574 | B2 | 8/2013 | Suzuki et al. |
| 8,596,082 | B2 | 12/2013 | Sung et al. |
| 2004/0016254 | A1 | 1/2004 | Park |
| 2005/0217290 | A1 | 10/2005 | Watakabe et al. |
| 2007/0012054 | A1* | 1/2007 | Schenk ..... F25D 29/00 62/208 |
| 2007/0144190 | A1 | 6/2007 | Temmyo et al. |
| 2010/0063634 | A1 | 3/2010 | Sung et al. |
| 2012/0222436 | A1 | 9/2012 | Li et al. |
| 2012/0318007 | A1 | 12/2012 | Lukasse et al. |
| 2014/0053581 | A1 | 2/2014 | Cho et al. |
| 2014/0208783 | A1 | 7/2014 | Lee et al. |
| 2015/0276306 | A1 | 10/2015 | Gomes et al. |

FOREIGN PATENT DOCUMENTS

| | | |
|---|---|---|
| CN | 1871482 | 11/2006 |
| CN | 101233374 | 7/2008 |
| CN | 102022887 | 4/2011 |
| CN | 102460048 | 5/2012 |
| CN | 102506536 | 6/2012 |
| CN | 103968633 | 8/2014 |
| EP | 0 791 162 | 3/2004 |
| JP | H 05157432 | 6/1993 |
| JP | 2012-202623 | 10/2012 |
| KR | 930018251 | 9/1993 |
| KR | 10-0129507 | 4/1998 |
| KR | 10-0129515 | 4/1998 |
| KR | 10-0130056 | 4/1998 |
| KR | 19980054641 | 9/1998 |
| KR | 10-0196943 | 6/1999 |
| KR | 10-2001-0078702 | 8/2001 |
| KR | 10-0293699 | 11/2001 |
| KR | 10-2006-0081920 | 7/2006 |
| KR | 10-2008-0088849 | 10/2008 |
| KR | 10-2008-0089780 | 10/2008 |
| KR | 10-2009-0101000 | 9/2009 |

OTHER PUBLICATIONS

Korean Office Action dated Jun. 8, 2023 issued in Application No. 10-2016-0161285.
International Search Report (with English Translation) and Written Opinion dated Apr. 11, 2017 issued in Application No. PCT/KR2016/014555.
European Search Report dated Jul. 22, 2019 issued in Application No. 16875989.2.
Chinese Office Action dated Dec. 4, 2019 issued in Application No. 201680073965.0 (English translation attached).
Chinese Office Action dated Jan. 6, 2022 issued in CN Application No. 202110060732.X.
Chinese Office Action dated Aug. 3, 2022 issued in Application No. 202110060732.X.
Korean Notice of Allowance dated Oct. 23, 2023 issued in Application No. 10-2016-0161285.

* cited by examiner

REFRIGERATOR HAVING A COLD AIR SUPPLY MEANS AND CONTROL METHOD THEREFORE

CROSS-REFERENCE TO RELATED PATENT APPLICATIONS

This application is a Continuation of U.S. application Ser. No. 17/148,379, filed on Jan. 13, 2021, which is a Continuation of U.S. application Ser. No. 15/780,587, filed on May 31, 2018, now U.S. Pat. No. 10,941,969, issued on Mar. 9, 2021, which is a U.S. National Stage Application under 35 U.S.C. § 371 of PCT Application No. PCT/KR2016/014555, filed Dec. 12, 2016, which claims priority to Korean Patent Application No. 10-2015-0179493, filed Dec. 15, 2015, and Korean Patent Application No. 10-2016-0161285, filed Nov. 30, 2016, whose entire disclosures are hereby incorporated by reference.

TECHNICAL FIELD

The present invention relates to a refrigerator and a control method therefor.

BACKGROUND ART

Refrigerators are home appliances that store foods at a low temperature. It is essential that a storage compartment is always maintained at a constant low temperature. At present, in the case of household refrigerators, the storage compartment is maintained at a temperature within the upper and lower limit ranges on the basis of a set temperature. That is, the refrigerator is controlled through a method in which when the storage compartment increases to the upper limit temperature, a refrigeration cycle operates to cool the storage compartment, and when the storage compartment reaches the lower limit temperature, the refrigeration cycle is stopped.

A constant temperature control method for maintaining a storage room of a refrigerator at a certain temperature is disclosed in Korean Patent Publication No. 1997-0022182 (published on May 28, 1997).

According to the prior art document, when a storage room temperature is higher than a set temperature, a compressor and a fan are driven, and simultaneously, the storage room damper is fully opened. When the storage room temperature is cooled to the set temperature, the driving of the compressor and/or the fan is stopped, and simultaneously, the storage room damper is closed.

The control method of the refrigerator according to the prior art has the following problems.

First, since a process of stopping an operation of the compressor is repeated when the storage room temperature is cooled to the set temperature or less after the storage room temperature of the refrigerator increases to the set temperature or more, and the compressor is driven, power consumption increases when the compressor is driven again.

Also, there is a disadvantage in that a large amount of cooling power is required at an initial stage of driving the compressor, and power consumption increases due to the driving of the compressor.

Second, since a damper is fully opened to cool the storage room, there is high possibility that cool air is excessively supplied to the storage room in a state in which the damper is fully opened so that the storage room is overcooled. That is, it may be difficult to maintain the constant temperature state of the storage room.

Third, in a structure in which the damper is installed on a partition wall for partitioning a freezing compartment and a refrigerating compartment, and the damper is fully opened to supply cool air of the freezing compartment into the refrigerating compartment, the refrigerating compartment is overcooled due to the excessive supply of the cool air, but a freezing compartment load rapidly increases.

DISCLOSURE OF THE INVENTION

Technical Problem

The present invention provides a refrigerator that is controlled to reduce possibility in which a temperature of a storage room deviates form a normal temperature so as to improve freshness of a stored object and a control method thereof.

The present invention provides a refrigerator that is recovered to a constant temperature state when a temperature of a storage room deviates from the constant temperature state so as to improve freshness of a stored object and a control method thereof.

The present invention provides a refrigerator that is capable of reducing power consumption of a cool air supply means while a storage room is maintained at a constant temperature and a control method thereof.

Technical Solution

A method for controlling a refrigerator according to one aspect includes: sensing a temperature of a storage room; operating a cool air supply means at a cooling power when the sensed temperature of the storage room is above a first reference temperature; operating the cool air supply means at a delay power, which is less than the cooling power, when the sensed temperature of the storage room is equal to or below a second reference temperature, which is less than the first reference temperature while the cool air supply means is operating at the cooling power; and allowing a control unit to determine a cooling power or a delay power of the cool air supply means according to the temperature of the storage room while the cool air supply means is operating at the delay power, and operating the cool air supply means at the determined cooling power or delay power.

A method for controlling a refrigerator according to another aspect includes: sensing a temperature of a storage room; operating a compressor at an initial cooling power when the sensed temperature of the storage room is above a first reference temperature; operating the compressor at a delay power, which is less than the initial cooling power, when the sensed temperature of the storage room is below a second reference temperature, which is less than the first reference temperature while the compressor operates at the initial cooling power; and allowing a control unit to determine the cooling power or the delay power of the compressor according to the temperature of the storage room while the compressor operates at the delay power, and operating the compressor at the determined cooling power or delay power.

The control unit may continuously operate the compressor so that the temperature of the storage room is maintained between the first reference temperature and the second reference temperature.

A method for controlling a refrigerator according to further another aspect includes: sensing a temperature of a storage room; operating a fan motor for circulating cool air of the storage room at an initial cooling power when the sensed temperature of the storage room is above a first reference temperature; operating the fan motor at a delay power, which is less than the initial cooling power, when the sensed temperature of the storage room is below a second reference temperature, which is equal to or less than the first reference temperature while the compressor operates at the initial cooling power; and allowing a control unit to determine the cooling power or the delay power of the fan motor according to the temperature of the storage room while the fan motor operates at the delay power, and operating the fan motor at the determined cooling power or delay power.

The control unit may continuously operate the fan motor so that the temperature of the storage room is maintained between the first reference temperature and the second reference temperature.

A method for controlling a refrigerator according to further another aspect includes: sensing a temperature of a refrigerating compartment; opening a damper at a cooling angle to allow cool air of a freezing compartment to the refrigerating compartment when the temperature of the refrigerating compartment is above a first reference temperature; decreasing an opening angle of the damper at a delay angle less than the cooling angle when the sensed temperature of the refrigerating compartment is below a second reference temperature less than the first reference temperature after the damper is opened at the cooling angle; allowing the control unit to determine an opening angle of the damper according to the temperature of the refrigerating compartment after the opening angle of the damper decreases, and opening the damper at the determined opening angle.

The control unit may maintain the damper in the opened state while the compressor operates to maintain the temperature of the refrigerating compartment with a range between the first reference temperature and the second reference temperature.

A refrigerator according to further another aspect includes: a cabinet provided with a storage room; a compressor operating to cool the storage room; a fan circulating cool air of the storage room; a fan motor rotating the fan; and a control unit controlling the compressor and the fan motor.

The control unit may adjust one or more outputs of the compressor and the fan motor so that the temperature of the storage room is maintained in a range between the first reference temperature greater than a target temperature of the storage room and the second reference temperature less than the target temperature while one or more of the compressor and the fan motor continuously operate.

When the temperature of the storage room is equal to or less than the second reference temperature while the compressor operates, the control unit may controls the compressor to allow the compressor to operate at the delay power that is greater than a minimum power.

When the temperature of the storage room reaches a predetermined temperature while the compressor operate at a power greater than the minimum output, the control unit operate the compressor at an initial cooling power of the compressor or a cooling power less than the initial cooling power.

A refrigerator according to further another aspect includes: a cabinet provided with a freezing compartment and a refrigerating compartment; a compressor operating to cool the freezing compartment; a fan circulating cool air of the freezing compartment; a damper disposed on a passage guiding the cool air of the freezing compartment to the refrigerating compartment; and a control unit controlling an opening angle of the damper.

The control unit may adjust an opening angle of the damper in the state in which the compressor operates, and the damper is opened so that the temperature of the refrigerating compartment is maintained within a range between the first the first reference temperature greater than a target temperature of the refrigerating compartment and a second reference temperature less than the target temperature.

When the temperature of the refrigerating compartment is equal to or less than the second reference temperature while the compressor operates, the control unit may controls the opening angle of the damper so that the opening angle of the damper is angled above a minimum angle greater 0.

When the temperature of the refrigerating compartment reaches a predetermined temperature in the state in which the opening angle of the damper is opened at an angle greater than a minimum angle, the control unit may control the opening angle of the damper so that the opening angle of damper is opened at a maximum angle or a cooling angle less than the maximum angle.

Advantageous Effects

According to the proposed embodiments, since the temperature of the storage room is constantly maintained, the storage period of the stored object may increase. That is, a phenomenon in which the foods stored in the storage room are overcooled or withered may be removed.

Also, to maintain the temperature of the storage room at the constant level, the compressor may not be stopped and be maintained in the driven state, but be driven at the power less than the cooling power at the time of the initial driving, thereby reducing the power consumption required for driving the compressor.

That is to say, the power consumption may be reduced as compared with the case of simple operation in which the compressor is repeatedly driven and stopped when the compressor continuously operates without stopping the driving of the compressor.

Also, there may be an advantage that the noise due to the repetition of the turn-on/off operation of the compressor may be reduced.

DETAILED DESCRIPTION OF THE EMBODIMENTS

Figure 1:
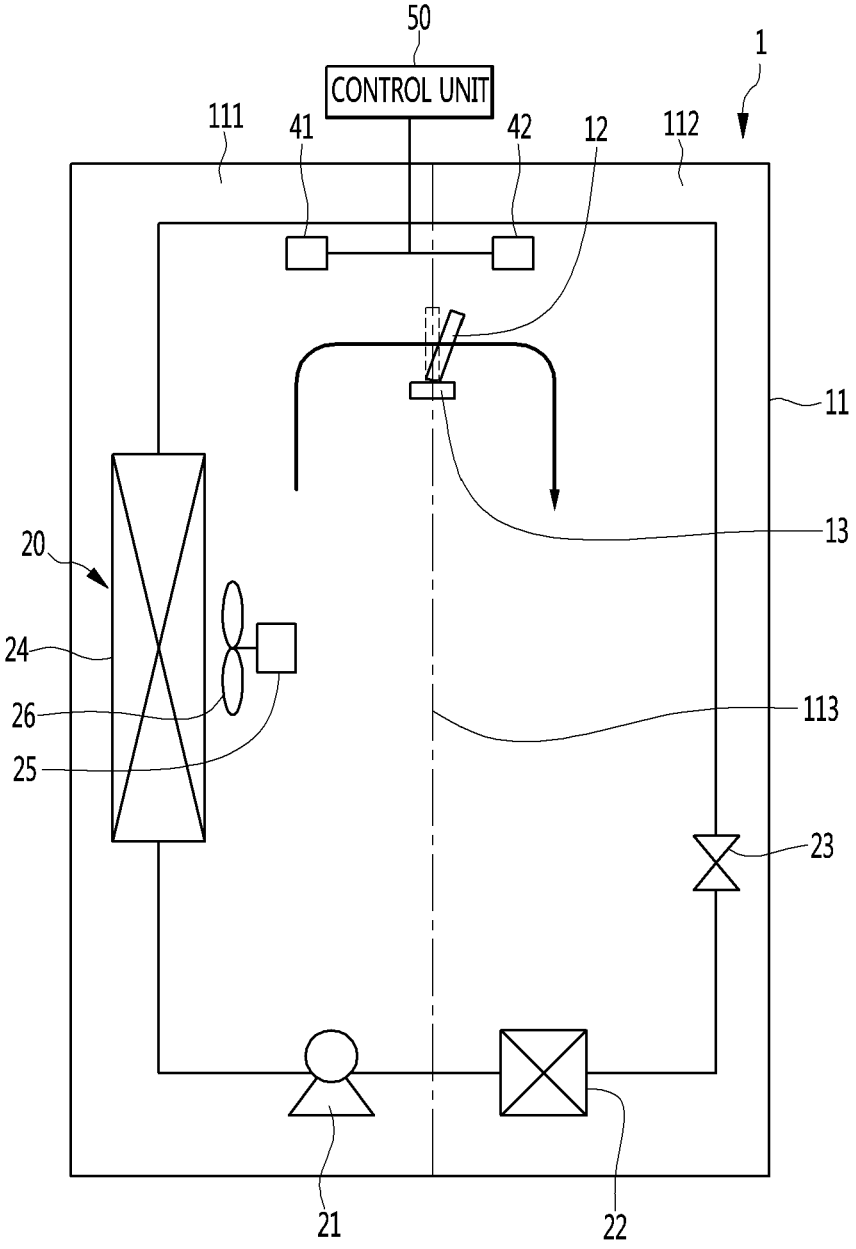
FIG. 1 is a schematic view illustrating a configuration of a refrigerator according to a first embodiment of the present invention.

Hereinafter, embodiments of the present invention will be described in detail with reference to the accompanying drawings. It is noted that the same or similar components in the drawings are designated by the same reference numerals as far as possible even if they are shown in different drawings. In the following description of the present invention, a detailed description of known functions and configurations incorporated herein will be omitted to avoid making the subject matter of the present invention unclear.

In the description of the elements of the present invention, the terms first, second, A, B, (a), and (b) may be used. However, since the terms are used only to distinguish an element from another, the essence, sequence, and order of the elements are not limited by them. When it is described that an element is "coupled to", "engaged with", or "connected to" another element, it should be understood that the element may be directly coupled or connected to the other element but still another element may be "coupled to", "engaged with", or "connected to" the other element between them.

FIG. 1 is a schematic view illustrating a configuration of a refrigerator according to a first embodiment of the present invention.

Referring to FIG. 1, a refrigerator 1 according to a first embodiment of the present invention may include a cabinet 11 having a freezing compartment 111 and a refrigerating compartment 112 therein and a door (not shown) coupled to the cabinet 11 to open and close each of the freezing compartment 111 and the refrigerating compartment 112.

In detail, an object to be stored such as a food may be stored in each of the freezing compartment 111 and the refrigerating compartment 112.

The freezing compartment 111 and the refrigerating compartment 112 may be horizontally or vertically partitioned within the cabinet 11 by a partition wall 113. Also, a cool air hole may be formed in the partition wall 113, and a damper 12 may be installed in the cool air hole to open or close the cool air hole.

Also, the refrigerator 1 may include a cooling cycle for cooling the freezing compartment 111 and/or the refrigerating compartment 112.

In detail, the cooling cycle 20 may include a compressor 21 compressing a refrigerant to form a high-temperature high-pressure gas refrigerant, a condenser 22 condensing the refrigerant passing through the compressor 21 to form a high-temperature high-pressure liquid refrigerant, an expansion member 23 expanding the refrigerant passing through the condenser 22, and an evaporator 24 evaporating the refrigerant passing through the expansion member 23. Also, the evaporator 24 may include a freezing compartment evaporator.

Also, the refrigerator 1 may include a fan 26 for allowing air to flow toward the evaporator 24 to circulate cool air in the freezing compartment 111 and a fan motor 25 for driving the fan 26.

In order to supply the cool air to the freezing compartment 111, the compressor 21 and the fan motor 25 have to be operated. In order to supply the cool air to the refrigerating compartment 112, the damper 12 has to be opened as well as the compressor 21 and the fan motor 25 operate. Here, the damper 12 operates by a damper motor 13.

At least one of the compressor 21, the fan motor 25, or the damper 12 may be referred to as a "cool air supply means" which operates in connection with the other components to supply the cool air to the storage room.

The adjustment of a power of the cool air supply means in this specification represents adjustment of input powers of one or more of the compressor 21 and the fan motor 25 or an adjustment of an opening angle of the damper 12.

The refrigerator 1 may include a freezing compartment temperature sensor 41 for sensing a temperature of the freezing compartment 111, a refrigerating compartment temperature sensor 42 for sensing a temperature of the refrigerating compartment 112, and a control unit (or controller) 50 to control the cool air supply means based on the temperature sensed by each of the temperature sensors 41 and 42.

The control unit 50 may control one or more of the compressor 21 and the fan motor 25 to maintain the temperature of the freezing compartment 111 to a target temperature.

For example, the control unit 50 may control a power of the compressor 21 while the fan motor 25 operates at a constant rate or speed.

Alternatively, the control unit 50 may control a power (rotation rate or speed) of the fan motor 25 while the compressor 21 operates at a certain power.

The control unit 50 may control one or more powers of the compressor 21, the fan motor 25, and the damper motor 13 to maintain the temperature of the refrigerating compartment 112 to a target temperature.

For example, the control unit 50 may adjust an opening angle of the damper 12 while each of the compressor 21 and the fan motor 25 operate at a certain power.

In this specification, the power of the cool air supply means, which is "determined" by the control unit 50, includes a constant value set in advance or a variable value determined by a predetermined calculation method.

Hereinafter, a method for controlling a refrigerator according to a first embodiment of the present invention will be described.

In the present specification, a set temperature range of the storage room represents a range between a first reference temperature higher than the target temperature and a second reference temperature lower than the target temperature, and a control for maintaining the temperature of the storage room within the set temperature range is referred to as a constant control of the storage room.

Also, a temperature between the first reference temperature and the second reference temperature is referred to as a third reference temperature.

Here, the third reference temperature may be a target temperature of the storage room or a mean temperature of the first reference temperature and the second reference temperature, but is not limited thereto.

Figure 2A:
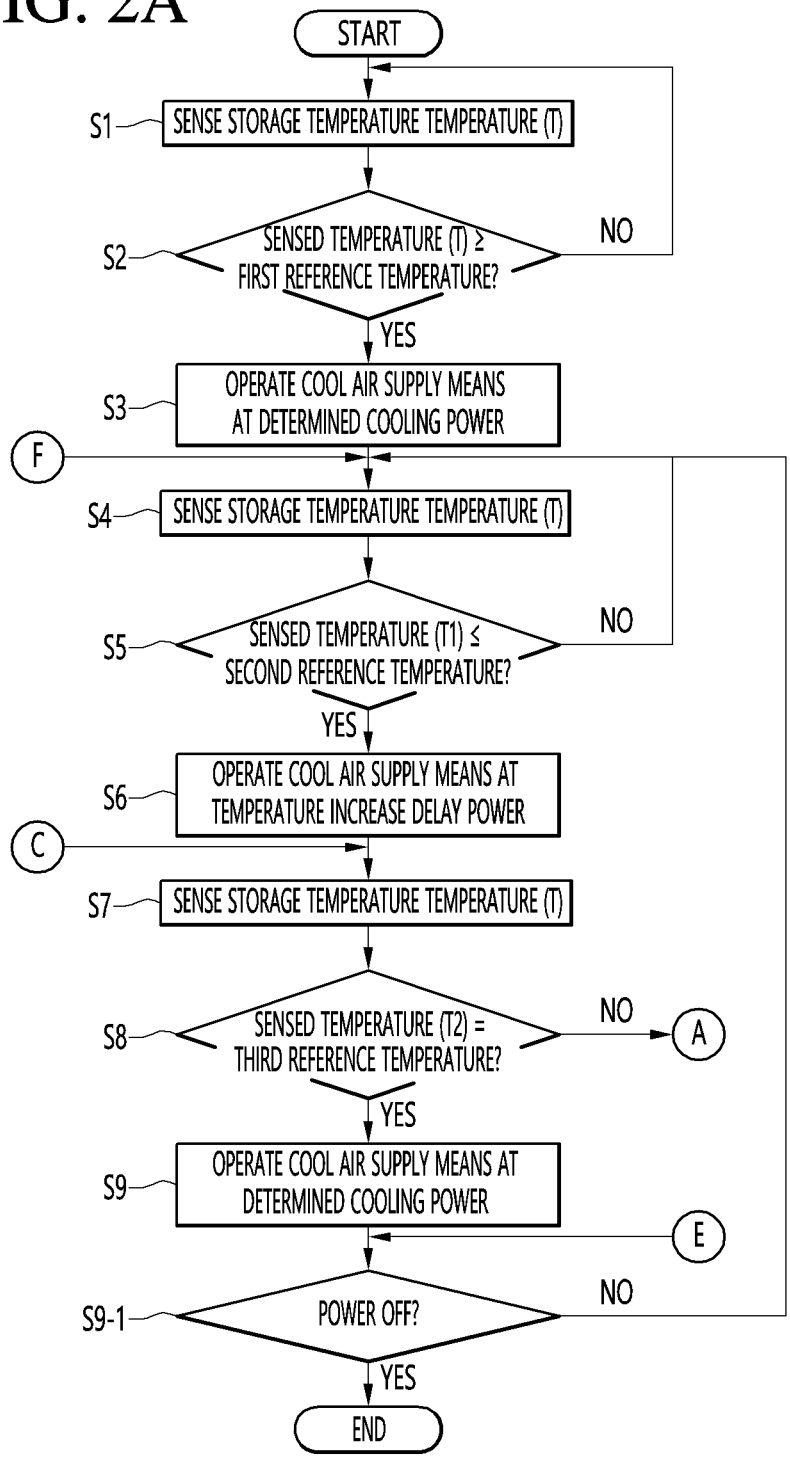
FIGS. 2A to 4 are flowcharts illustrating a method for controlling the refrigerator according to the first embodiment of the present invention.
Figure 2B:
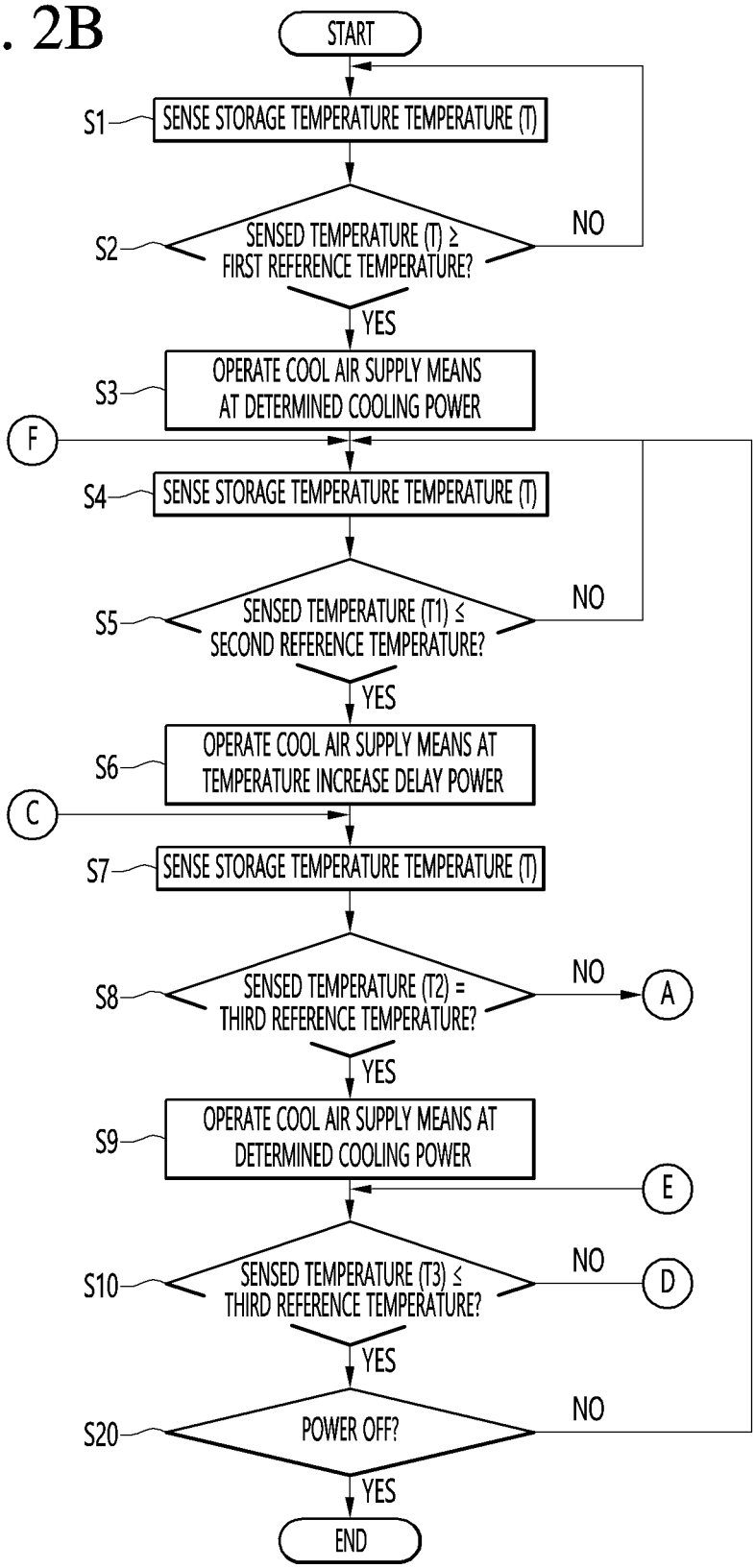
Figure 3:
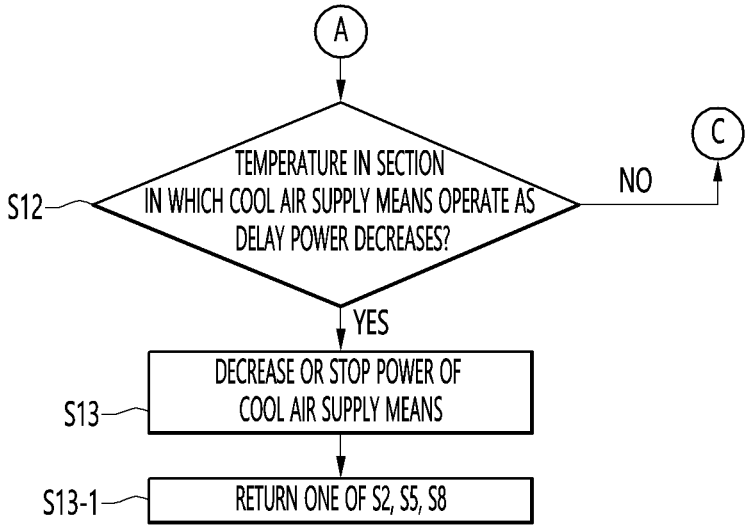
Figure 4:
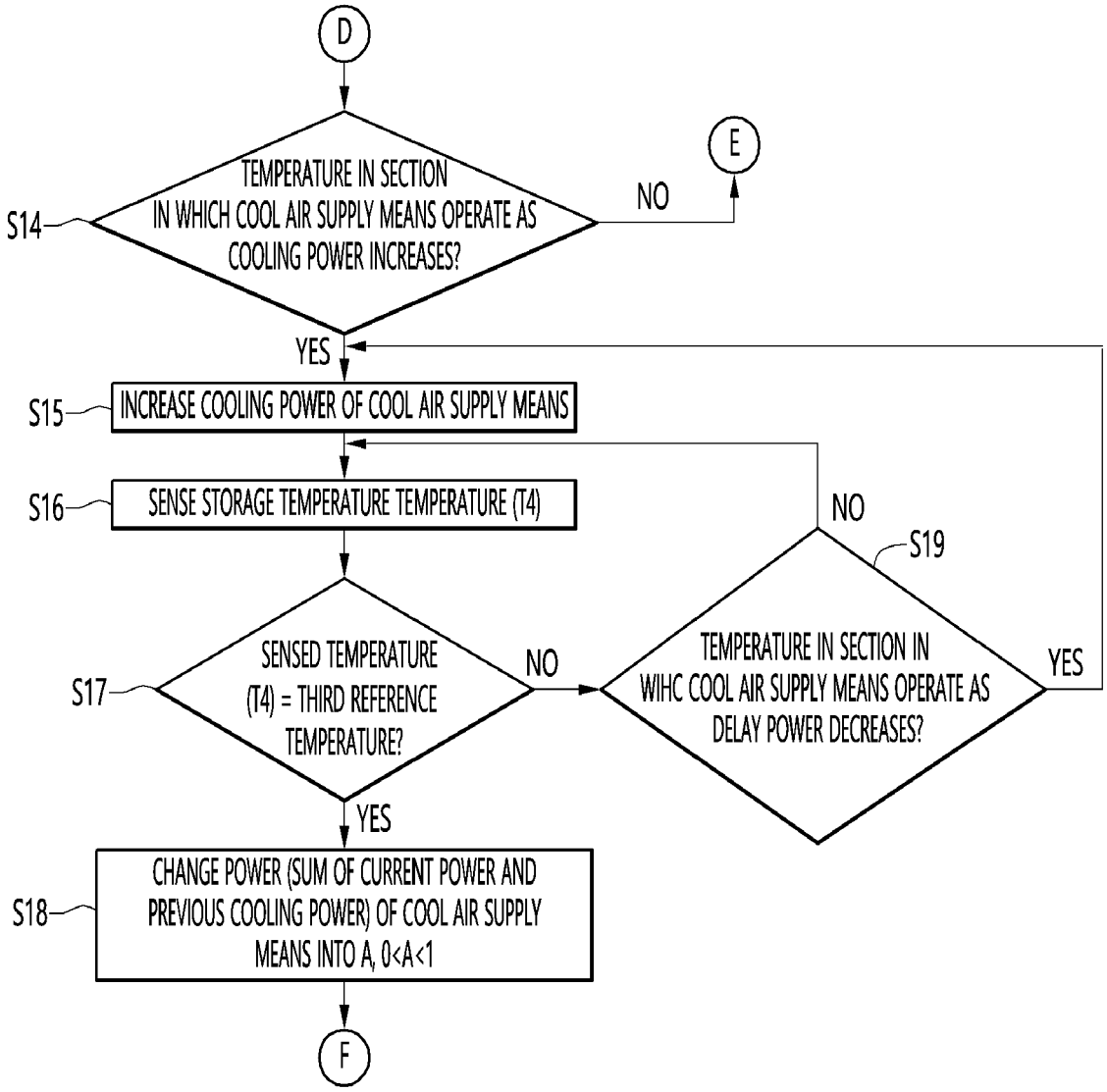
Figure 5:
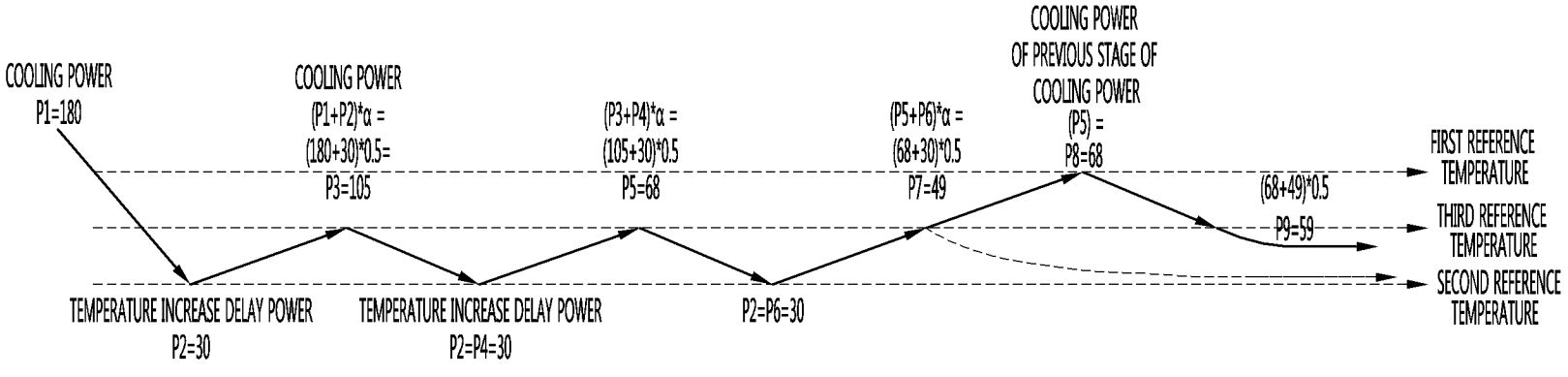
FIGS. 5 and 6 are graphs illustrating a variation in temperature of a storage room and a variation in power of a cool air supply means according to the method for controlling the refrigerator according to the first embodiment of the present invention.
Figure 6:
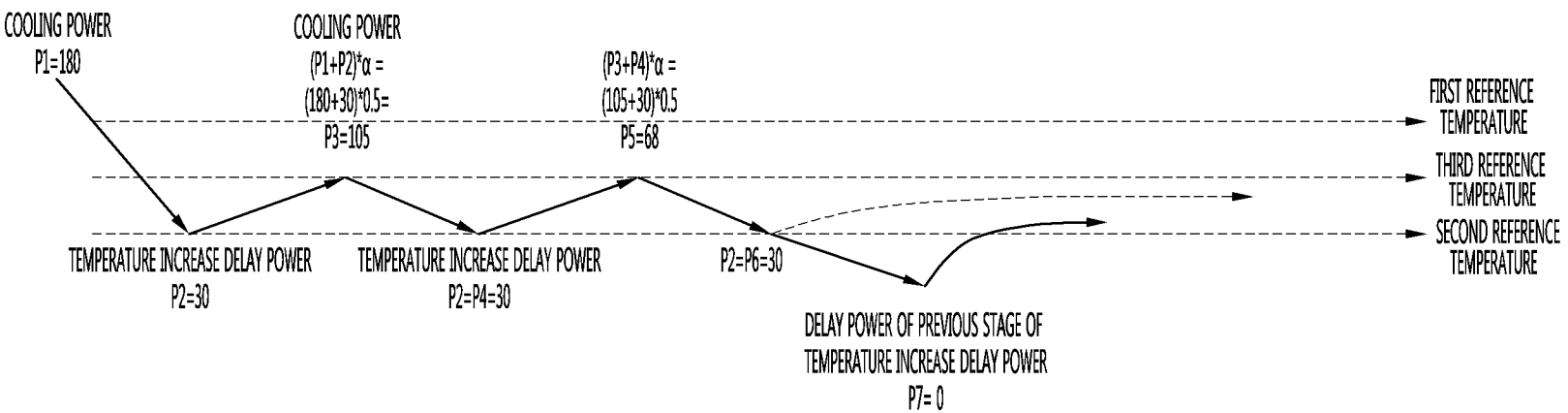

FIGS. 2 to 4 are flowcharts illustrating a method for controlling the refrigerator according to the first embodiment of the present invention, and FIGS. 5 and 6 are graphs illustrating a variation in temperature of the storage room and a variation in power of the cool air supply means according to the method for controlling the refrigerator according to the first embodiment of the present invention.

Referring to FIGS. 2 to 6, a temperature T of the storage room is sensed by one of temperature sensors 41 or 42 to perform the constant control (S1). In the present invention, it is assumed that the refrigerator is in an initial state in which the refrigerator is turned on.

The control unit 50 determines whether the sensed temperature T of the storage room is above the first reference temperature (S2).

In the initial stage of the refrigerator, which is turned on, since the temperature T of the storage room is close to room temperature, the sensed temperature T of the storage room may be above the first reference temperature.

As the determination result in the operation S2, when it is determined that the sensed temperature T of the storage room is above the first reference temperature, the control unit 50 determines a cooling power P1 (initial cooling power) of the cool air supply means to decrease the temperature of the storage room and allow the cool air supply means to operate at the determined cooling power P1 (S3).

In this specification, the cooling power may be controlled in stepwise or linearly, and the actual power value may be calculated, or calculated as a leveled value.

It is noted that a value of the cooling power illustrated in the drawings of this specification is an indicative value, i.e., a leveled value and is determined as a natural number for the sake of understanding (when the cooling power calculated by the control unit has a decimal point, the level is rounded to be determined).

For example, for the constant temperature of the freezing compartment 111, the control unit 50 may control the compressor 21 to operate at a first reference power and control the fan motor 25 to operate at a second reference power.

Also, the control unit 50 may additionally adjust the power of the damper motor 13 so that the opening angle of the damper 12 becomes a first reference angle for the constant temperature of the refrigerating compartment 112.

Here, the first reference power may be a maximum power of the compressor 21 or a power that is less than the maximum power.

Also, the second reference power may be a maximum power of the fan motor 25 (the power of which the rotation rate of the fan motor is maximized) or the power that is less than the maximum power.

However, the more the first reference power and the second reference power are close to the maximum power, the more the temperature decrease rate of the storage room may increases. Also, the more the first reference angle is close to a maximum opening angle of the damper 12, the more the temperature decrease rate of the storage room may increase.

When the cool air supply means operates as the cooling power P1, the temperature of the storage room may gradually decrease.

The temperature of the storage room may be periodically sensed by the temperature sensors 41 and 42 (S4).

Also, the control unit 50 determines whether a sensed temperature T1 of the storage room is below the second reference temperature (S5).

As the determination result in the operation S5, when it is determined that the sensed temperature T1 of the storage room is below the second reference temperature, the control unit 50 controls the cool air supply means to operate at a temperature increase delay power P2 (hereinafter, referred to as a "delay power") so that the temperature of the storage room increases, but the temperature increase is delayed (S6).

When compared with the conventional technique in which the cool air supply means is stopped when the temperature of the storage room reaches the second reference temperature, in the case of the present invention, the cool air supply means may operate as the temperature increase delay power to delay a time taken to allow the temperature of the storage room to reach a value that is above the first reference temperature. In this case, a degree of a variation in temperature within the storage room may be reduced to improve freshness of the stored object.

Also, the number of times of turn-on/off operations of the cool air supply means may be reduced to improve reliability of parts of the cool air supply means.

In the present invention, after the sensed temperature T1 of the storage room is determined to be less than the second reference temperature, the temperature of the storage room has to increase for constant temperature control of the storage room.

In this case, when the cool air supply means is stopped (including when the damper is closed), the temperature increase rate of the storage room is the fastest. However, in the present invention, the cool air supply means is not stopped, and the cool air supply means operates as the delay power.

It is preferable that the delay power P2 determined in operation S6 is determined to be a value less than the cooling power P1 determined in the previous operation S3.

The delay power P2 may be equal to or greater than a minimum power at which the cool air supply means operates. Also, the delay power P2 may be an angle at which the opening angle of the damper is greater than zero, which is the closing angle.

For example, when the sensed temperature T1 of the storage room is equal to or less than the second reference temperature, the control unit 50 may allow at least one of the compressor 21 and the fan motor 25 to operate at a power of a minimum power or more.

Alternatively, when the sensed temperature T1 of the storage room is equal to or less than the second reference temperature, the control unit 50 may control the damper motor 13 to maintain the opening angle of the damper 12 to be greater than 0, which is the closing angle.

Also, the temperature T2 of the storage room is sensed by one of the temperature sensors 41 or 42 (S7).

The control unit 50 determines whether the sensed temperature T2 of the storage room reaches the third reference temperature (S8).

As the determination result in the operation S8, when it is determined that the sensed temperature T2 of the storage room reaches the third reference temperature, the control unit 50 determines adjusted cooling powers (or first cooling levels) P3, P5, and P7 of the cool air supply means for respective time periods and allows the cool air supply means to operate at the determined adjusted cooling powers P3, P5, and P7 (S9) during the respective time periods.

When the temperature of the storage room increase to reach the third reference temperature, the cooling power determined in operation S9 is determined to be larger than the delay power determined in operation S6 so that the temperature of the storage room decreases again.

Also, the cooling power determined in operation S9 is a value greater than the delay power determined in the previous operation S6 and may be determined to be a value less than or equal to the cooling power determined in the operation S3 before the operation S6.

Each of the determined cooling powers P3, P5, and P7 is a value greater than that of one of the delaying powers (or second cooling levels) P2, P4, and P6 for respective time periods and may be determined to be a value less or equal to one of the previous cooling powers.

The cooling powers P3, P5, and P7 determined in operation S9 may be the powers between the powers for delay P2, P4, and P6 and the previously determined cooling powers.

Although not limited, each of the adjusted cooling powers P3, P5, and P7 when the detected temperature T2 of the storage room reaches the third reference temperature may be determined as a value of (the sum of one value of delay powers P2, P4, and P6 driven in the previous operation and one value of the cooling powers driven in the previous operation)×α. Here, α is greater than 0 and less than 1, may be set in advance in the memory, and may be set by the user or automatically changed.

For example, the cooling power P3, P5, and P7 when the sensed temperature T2 of the storage room reaches the third reference temperature is a value (the delay power and the mean power value of the previously determined cooling power) of (the sum of the delay power and the previously determined cooling power)×0.5, but the present invention is not limited thereto.

As illustrated in FIG. 2A, after the cool air supply means operates at the determined cooling power P3 (S9), if a power off command of the refrigerator is not inputted (S9-1), the process returns to the operation S4 and repeats operations S4 to S9.

That is, in FIG. 2A, after the operation S9 is completed, the operation S9-1 may be performed immediately without sensing the storage room temperature. When the power off command of the refrigerator is not input (S9-1), the process returns to the operation S4.

As illustrated in FIG. 2B, the operation S10 may be added to determine whether the temperature T3 of the storage room sensed, by the control unit 50, is less than the third reference temperature during the operation of the cooling power P3 determined in operation S9.

As the determination result in the operation S10, when the sensed temperature T3 of the storage room is less than the third reference temperature, the process returns to the operation S4 unless the power off command for the refrigerator is input (S20). Then, the operations S4 to S9 may be repeatedly performed.

Here, when the operations S4 to S9 are repeated, as illustrated in FIG. 5, the temperature of the storage room may be maintained between the third reference temperature and the second reference temperature.

Also, when the operations S4 to S9 are repeated, as illustrated in FIG. 5, the cooling powers P3, P5, and P7, which are determined when the sensed temperature T2 of the storage room reaches the third reference temperature, will be gradually reduced to be close to the delay powers P2, P4, and P6.

As described above, when the operations S4 to S9 are repeated, the cooling power is gradually reduced during the operation of the cool air supply means so that the power consumption of the cool air supply means is reduced even if the cool air supply means continuously operates.

Hereinafter, a protection logic A (operations S12 to S13) will be described with reference to FIG. 3.

During the cool air supply means operates at the delay power determined in operation S6 (i.e., a temperature increase interval) (S7), an operation S12 may be added to sense the storage room temperature T2 and determine whether the temperature of the storage room decreases in the temperature increase interval.

As the determination result in the operation S12, if it is determined that the temperature of the storage room is decreasing, operation S13 of decreasing the delay power or stopping the cool air supply means may be added.

That is, the operation S8 is omitted in FIG. 2A or 2B, and the process directly proceeds to the operation S12.

In the case in which the temperature of the storage room decreases due to an inflow of external air having a temperature less than that of air in the storage room in the state that the refrigerator door is opened, or in the case in which a cool air source is further introduced into the storage compartment, if the temperature T2 of the storage room decreases in the temperature increase period, the storage room may be overcooled. Therefore, the operation S12 may be additionally performed by necessity to minimize the temperature increase delay of the storage room.

An amount of temperature T2 of the storage room may have a negative (−) value for a predetermined time after the cool air supply means starts to operate at the delay power (P6 in FIG. 6) determined in the operation S6, or when the storage room temperature T2 that operates by the delay power P6 reaches a value that is less than a specific value (for example, the storage room temperature or the second reference temperature when the operation starts at the delay power P6), it may be determined that the temperature of the storage room decreases in the temperature increase period.

Alternatively, as the determination result in the operation S8, if it is determined that the sensed storage room temperature T2 does not reach the third reference temperature, the control unit 50 may determine whether the storage room temperature T2 decreases in the temperature increase period (S12).

As the determination result in the operation S12, if it is determined that the temperature T2 of the storage room is decreasing, operation S13 of decreasing the delay power or stopping the cool air supply means may be added.

For example, the control unit 50 may determine the delay powers (P7 in FIG. 6) so that the cool air supply means may be operated at the minimum power or the delay powers (P4 and P2 in FIG. 6) previously determined.

Alternatively, the control unit 50 may determine the mean power value of the previously determined delay powers P4 and P2 as the delay power P7 of the cool air supply means. Alternatively, a value less than the delay power for the immediately preceding delay may be determined as the delay power P7 by decreasing a.

The operation S13 of reducing the delay power or stopping the cool air supply means is performed as described above, and after sensing the temperature of the storage room, a step of determining again whether the temperature of the storage room decreases in a temperature increase period may be added. As a result of the determination, if it is determined that the temperature of the storage room is decreasing, the delay power may be more reduced.

The cool air supply means is stopped or operates at the reduced power including the minimum power (S13). When it is determined that the temperature of the storage room does not decrease after sensing the storage room temperature, the repetitive performance of the protection logic A may be cancelled. Alternatively, when the cool air supply means operates for a predetermined time at the reduced power, the repetitive performance of the protection logic A may be cancelled.

The cancel of the execution of the protection logic A represents returning to any operations S1 to S9-1 ("basic logic") to perform the subsequent operations (S13-1).

For example, after the cool air supply means is stopped or operates at the reduced power including the minimum power, if the temperature of the storage room is equal to or greater than the first reference temperature, the operations after the operation S2 may be performed. Alternatively, after the cool air supply means is stopped or operates at the reduced power including the minimum power, if the temperature of the storage room is equal to or less than the second reference temperature, the operations after the operation S5 may be performed. Alternatively, after the cool air supply means is stopped or operates at the reduced power including the minimum power, if the temperature of the storage room is the third reference temperature, the operations after the operation S8 may be performed.

For example, although the cool air supply means is driven by the delay power P6 in FIG. 6, when the temperature of the storage room is overcooled below the second reference temperature, the cool air supply means may be driven at the delayed power P7 that is modified according to the protection logic A.

When the cool air supply means is driven at the delay power P7, and the storage room temperature increases again, the protection logic A is ended and returned to the basic logic.

Therefore, when the storage room temperature reaches the third reference temperature, the power P8 of the next stage is determined to be the value of (the sum of the cooling power P6 of the previous stage and the delay power P7 of the previous stage)×α. Since the delay power P6 is actually cooled without increasing the temperature of the storage room, it is recognized as the cooling power P6 of the previous stage.

For example, if it is determined in the operation S12 that the sensed temperature T2 of the storage room is equal to or less than the second reference temperature, the control unit 50 may stop the operation of the cool air supply means (S13). In the present invention, in the case of the refrigerating compartment constant control, the operation of the cool air supply means is stopped to control the opening angle of the damper so that the opening angle of the damper is actually zero.

Alternatively, when the delay power P2, P4, and P6 are greater than the minimum power, the control unit 50 may control the cool air supply means to operate at the minimum power.

When the cool air supply means is stopped or operates at minimum power, the temperature of the storage room may increase.

After performing the operation S13, α may vary. For example, after performing the operation S13, α may be set to a value less than the current value.

The case in which the temperature T3 of the storage room reaches a value equal to or greater than the first reference temperature while the cool air supply means operates as the cooling power, may be, for example, a case in which the refrigerator door is opened to increase the temperature of the storage room, a case in which the food is more introduced into the storage room, or a case in which the preset a is low.

Hereinafter, a protection logic B (operations S14 to S16) will be described with reference to FIG. 4.

In the section in which the cool air supply means operates at the cooling power (P7 in FIG. 5) determined in the operation S9 (i.e., the temperature decrease period), when it is determined that the temperature of the storage room increases (S14) after the temperature T3 of the storage room is sensed (S10), operation S15 of increasing the cooling power may be added. That is, In FIG. 2A, the operation S14 may be performed immediately after completion of the operation S9-1.

When the temperature T3 of the storage room increases in the temperature increase period in the case in which the refrigerator door opens and the temperature in the storage room increases, food is added to the storage room, or the preset alpha is low, the storage room may be overheated, so that the temperature decrease delay of the storage room has to minimized.

In order to increase the cooling power, for example, the control unit 50 may determine the cooling power P8 of the cool air supply means so that the cool air supply means operate at the maximum power or the cooling powers P5, P3, and P1 determined at the previous stage.

Alternatively, the control unit 50 may determine the mean power value of the previously determined cooling power P5, P3, and P1 as the cooling power P8 of the cool air supply means. Alternatively, the cooling power P8 may be determined to be greater than the immediately preceding cooling power by increasing a.

When a change amount of temperature T3 of the storage room has a positive (+) value for a certain time period after the cool air supply means starts to operate at the cooling power (P7 in FIG. 5), or when the storage room temperature T3 during which the cool air supply means is operating as the cooling power P7 starts to operate at a specific value (for example, the temperature of the storage room or the first reference temperature when operating as the cooling power P7), it may be determined that the temperature of the storage room increases in the temperature decrease period.

Alternatively, when the temperature T3 of the storage room at the time when a predetermined time elapses after the cool air supply means operates as the cooling power P7 starts to operate at a specific value (for example, when starting operation with the cooling power P7, the temperature of the storage room or the first reference temperature), or when a certain period of time has elapsed since the door of the refrigerator has been opened, it may be determined that the temperature of the storage room increases in the temperature decrease period.

As illustrated in FIG. 2B, if the detected temperature T3 of the storage room exceeds the third reference temperature after sensing the temperature T3 of the storage room in operation S10, the temperature T3 of the storage room increase (operation S14).

As the determination result in the operation S14, if it is determined in operation S14 that the storage room temperature T3 is increasing, the cooling power P8 may increases from the previous cooling power P7 (S15).

It is possible to add operation S19 for determining whether the temperature T4 of the storage room increases after the operation S15 of increasing the cooling power and sensing the storage room temperature T4 in operation S16. As the determination result in the operation S19, if it is determined that the temperature T4 of the storage room is increasing, the cooling power may increase again (S15). That is, after sensing the storage room temperature T4 in operation S16, operation S19 may be performed immediately.

As described above, the operation S15 of increasing the cooling power is performed, and the storage room temperature T4 is sensed in operation S16. Then, operation S17 in which it is determined whether the sensed temperature T4 has reached the third reference temperature may be added. As the determination result in the operation S17, if the sensed temperature has not reached the third reference temperature, operation S19 is again performed to determine whether the temperature T4 of the storage room increases in the temperature decrease period.

When the cool air supply means operates at an increase power (S15), the storage room temperature T4 is sensed (S16), and it is determined that the storage room temperature does not increase (S19), the execution of the protection logic B may be cancelled. Alternatively, when the increased power has operated for a certain time period, the execution of the protection logic B may be cancelled.

The cancel of the execution of the protection logic A represents returning to any operations S1 to S9-1 (basic logic) to perform the subsequent operations.

For example, after the cool air supply means operates at the increasing power (S15), if the temperature of the storage room is equal to or greater than the first reference temperature, the operations after the operation S2 may be performed.

Alternatively, after the cool air supply means operates at the increasing power, if the temperature of the storage room is equal to or less than the second reference temperature, the operations after the operation S5 may be performed.

Alternatively, after the cool air supply means operates at the increasing power, if the temperature of the storage room is the third reference temperature, the operations after the operation S5 may be performed.

For example, although the cool air supply means is driven by the cooling power P7 in FIG. 5, when the temperature of the storage room is overcooled above the first reference temperature, the cool air supply means may be driven at the cooling power P8 that is modified according to the protection logic B. When the cool air supply means is driven at the cooling power P8, and the storage room temperature decreases again, the protection logic B is ended and returned to the basic logic. Therefore, when the storage room temperature reaches the third reference temperature, the power P9 of the next stage is determined to be the value of the sum of the cooling power P8 of the previous stage and the delay power P7 of the previous stage×α. Since the cooling power P7 is actually cooled without decreasing the temperature of the storage room, it is recognized as the delay power P7 of the previous stage.

Referring to FIG. 5, for example, when the temperature T3 of the storage room sensed during the operation of the cool air supply means by the cooling power P7 becomes a value equal to or greater than the first reference temperature, the control unit 50 increases the current cooling power of the cool air supply means so as to decrease the temperature of the storage room.

For example, the control unit 50 may determine the cooling power P5 determined immediately before the current cooling power P7 as the increasing cooling power P8. If the temperature T3 of the storage room is equal to or greater than the first reference temperature even if the cool air supply means is driven by the cooling power P8, the control unit 50 may determine the cooling power P3 determined immediately before the cooling power P5 as the increasing cooling power.

Since the previously determined cooling powers P5, P3, and P1 are greater than the current cooling power P7, the temperature of the storage room may be less than the first reference temperature by an increase in the cooling power of the cool air supply means.

While the cool air supply means is operating at the changed cooling power P8, the temperature T4 of the storage room is sensed (S16).

Also, the control unit 50 determines whether a sensed temperature T4 of the storage room reaches the third reference temperature (S17).

As the determination result in the operation S17, when it is determined that the sensed temperature T4 of the storage room reaches the third reference temperature, the current cooling power of the cool air supply means is changed as a value of (the sum of the current cooling power and the previously determined cooling power)×α (S18).

Unlike the operation S17, in operation S15, while the cool air supply means is operating with the previously determined cooling power P8, the control unit 50 may determine whether the sensed temperature T4 of the storage room reaches a value equal to or less than the second reference temperature. Also, when the sensed temperature T4 of the storage room reaches a value below the second reference temperature, the control unit 50 may allow the cool air supply means to operate as the delay power.

Alternatively, as the determination result in the operation S17, if it is determined that the sensed storage room temperature T4 does not reach the third reference temperature, the control unit 50 may determine whether the temperature increases in a period during which the cool air supply means operates at the cooling power (S19).

For example, the control unit 50 determines whether the sensed temperature T4 of the storage room is above the first reference temperature.

As the determination result in the operation S19, when the sensed storage room temperature T4 is equal to or greater than the first reference temperature, the control unit 50 further increases the current cooling power of the cool air supply means (S15).

For example, when the cool air supply means operates at the previously determined cooling power P5, but the temperature T4 of the sensed storage room is equal to or greater than the first reference temperature, the control unit 50 may operate the cool air supply means at the previously determined cooling power P3.

In the present invention, the delay power does not vary unless the temperature of the storage room decreases below the second reference temperature in the course of operating the cool air supply means to the delay power. That is, the delay power may be a fixed power independent of the temperature change of the storage room.

As a result, the compressor and the fan motor constituting the cool air supply means do not stop unless the temperature of the storage room becomes less than the second reference temperature.

According to the present invention, the compressor 21 and the fan motor 25 continue to operate without stopping, and the power is controlled so that the power to be driven gradually converges to a state that is close to the minimum power, there is an advantage that the power consumption may be reduced as compared with the case where the turn-on/off operation of the compressor 21 and the fan motor 25 is repeated.

In addition, since the storage room temperature is maintained at a constant temperature within the set range, it is possible to maintain the fresh state for a long time without repeating the state where the stored food is overcooled.

Figure 7:
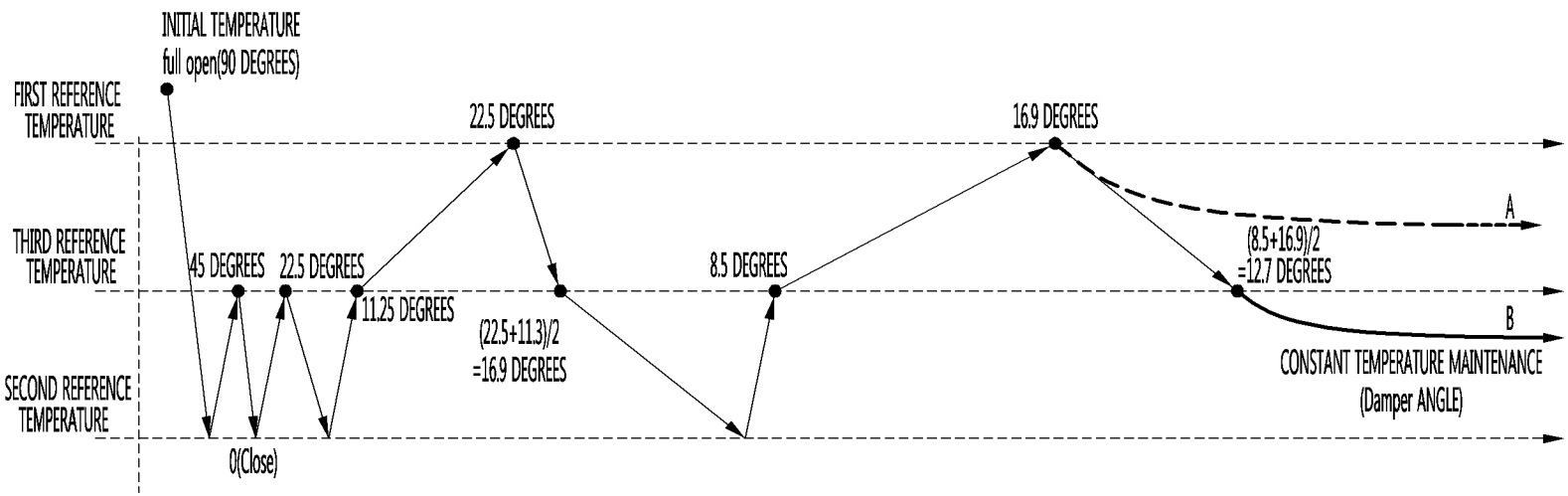
FIG. 7 is a graph illustrating a variation in temperature of a storage room and a variation in opening angle of a damper according to the method for controlling the refrigerator according to the first embodiment of the present invention.

FIG. 7 is a graph illustrating a variation in temperature of the storage room and a variation in opening angle of the damper according to the method for controlling the refrigerator according to the first embodiment of the present invention.

Referring to FIG. 7, according to the control method of the refrigerator described above, the damper is fully opened (for example, 90 degrees) in the initial state where the temperature of the refrigerating compartment is equal to or greater than the first reference temperature, and after that, the opening degree of the damper is adjusted, and thus the temperature may be maintained within the set temperature range.

For example, if the temperature of the refrigerating compartment reaches the second reference temperature or lower in a state in which the damper 12 is completely opened, in the case in which the damper 12 is closed or the opening angle of the damper 12 is set at the minimum angle, when the refrigerating compartment temperature increases to the third reference temperature, the operation of reducing the opening of the damper to N % of the previous opening angle (N is a value between 0 and 100) may be repeated.

Also, if the temperature of the refrigerating compartment increases suddenly while repeating the process of decreasing the opening angle of the damper 12 to N % of the previous opening angle, the opening angle of the damper may increase to the previous opening angle by the protection logic B.

Also, if the temperature of the refrigerating compartment decreases again after increasing the opening angle of the damper 12 to the previous opening angle, for example, the opening angle of the damper 12 may be re-adjusted by the mean value of the current opening angle and the previous opening angle.

On the other hand, although not shown in FIG. 7, if the temperature does not decrease even if the opening angle increases by the previous opening angle, the opening angle of the damper 12 may be changed by the protection logic A at the initial opening angle, that is, the fully opened state.

If this process is repeatedly performed, the temperature of the refrigerating compartment may be stably controlled (constant temperature control) within the set temperature range without stopping the driving of the compressor and the fan motor.

Figure 8:
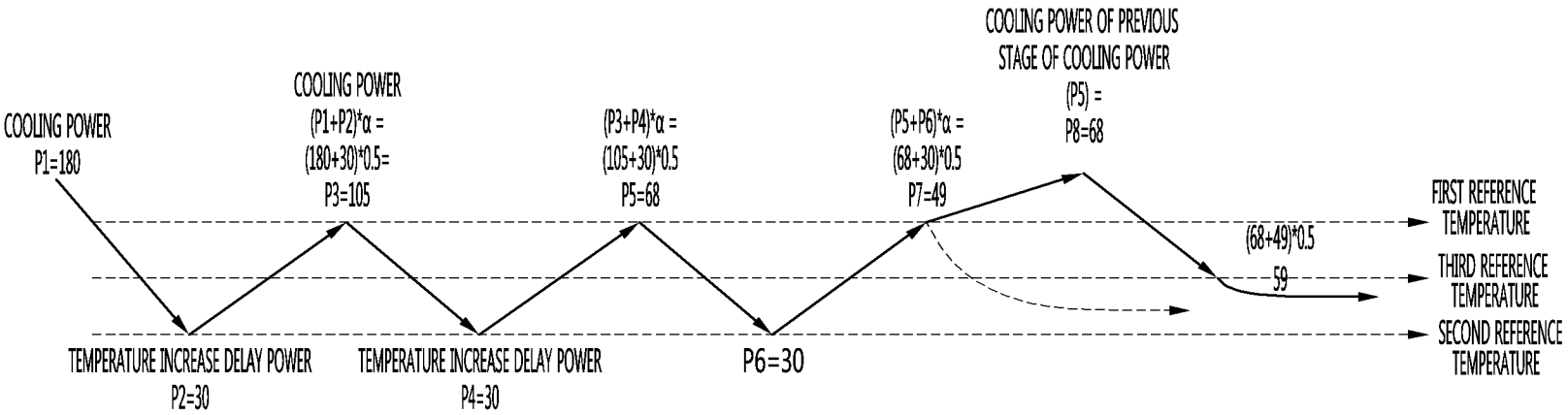
FIGS. 8 and 9 are graphs illustrating a variation in temperature of a storage room and a variation in power of a cool air supply means according to a method for controlling a refrigerator according to a second embodiment of the present invention.
Figure 9:
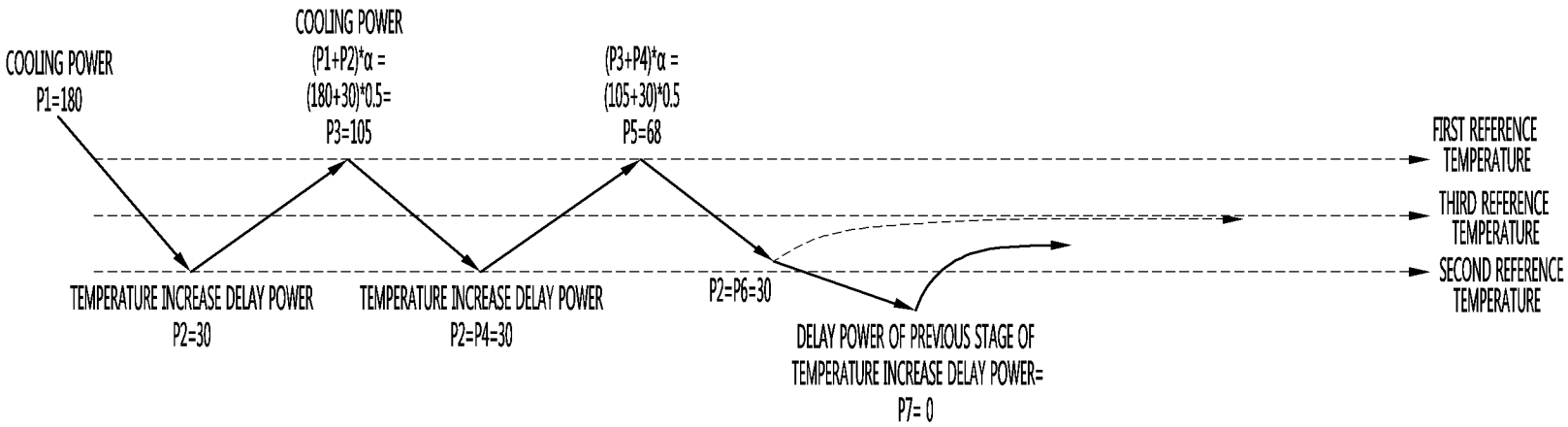

FIGS. 8 and 9 are graphs illustrating a variation in temperature of a storage room and a variation in power of a cool air supply means according to a method for controlling a refrigerator according to a second embodiment of the present invention.

The current embodiment is the same as the first embodiment except for a method for determining a cooling power. Thus, only characterized parts of the current embodiment will be principally described below, and descriptions of the same part as that of the first embodiment will be quoted from the first embodiment.

Referring to FIGS. 2 to 4, 8, and 9, since operations S1 to S6 of the first embodiment are the same as those of the control method of the present embodiment, a detailed description thereof will be omitted. However, the difference from operation S8 of the first embodiment will be described.

In this embodiment, while the cool air supply means is operating as the delay power P2, the control unit 50 determines whether the sensed temperature T2 of the storage room reaches a value equal to or greater than the first reference temperature.

When it is determined that the sensed temperature of the storage room reaches a value that is equal to or above the first reference temperature, the control unit 50 determines cooling powers P3, P5, and P7 of the cool air supply means and allows the cool air supply means to operate at the determined cooling powers P3, P5, and P7.

While the cool air supply means is operating as the cooling powers P3, P5, and P7, the control unit 50 determines whether the sensed temperature of the storage room reaches a value equal to or less than the first reference temperature. When it is determined that the sensed temperature of the storage room reaches a value that is equal to or below the second reference temperature, the control unit 50 determines delay powers P4 and P6 of the cool air supply means and allows the cool air supply means to operate at the determined delay powers P4 and P6.

In addition, all of the driving logic including the method for determining the cooling power and the delay power and the protection logics A and B are the same as those in the first embodiment.

Figure 10:
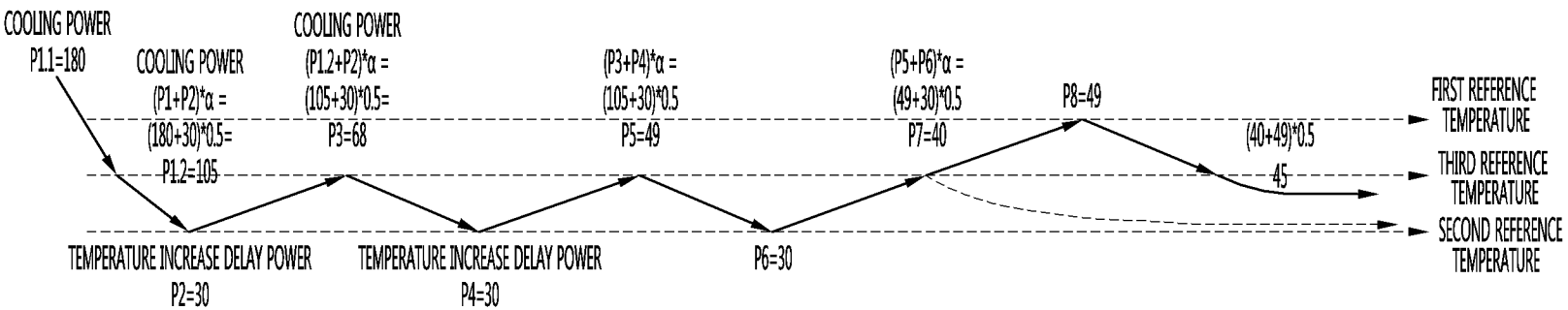
FIGS. 10 to 12 are graphs illustrating a variation in temperature of a storage room and a variation in power of a cool air supply means according to a method for controlling a refrigerator according to a third embodiment of the present invention.
Figure 11:
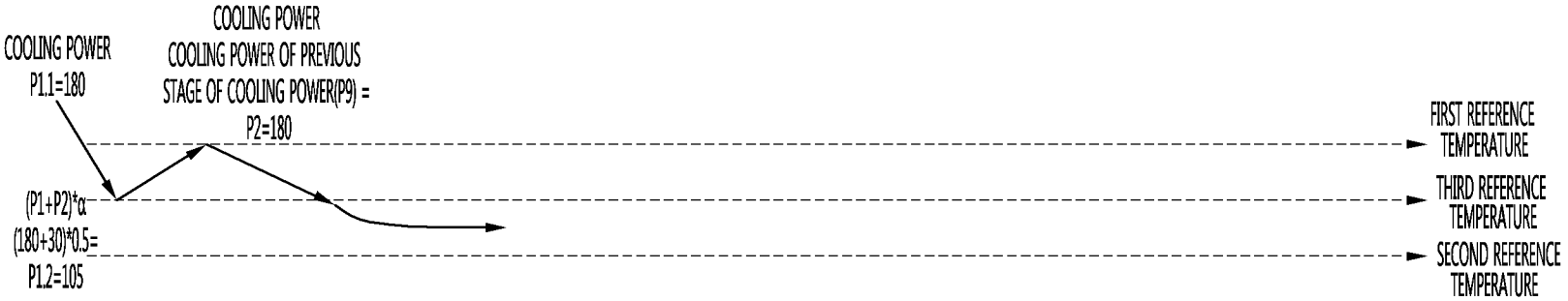
Figure 12:
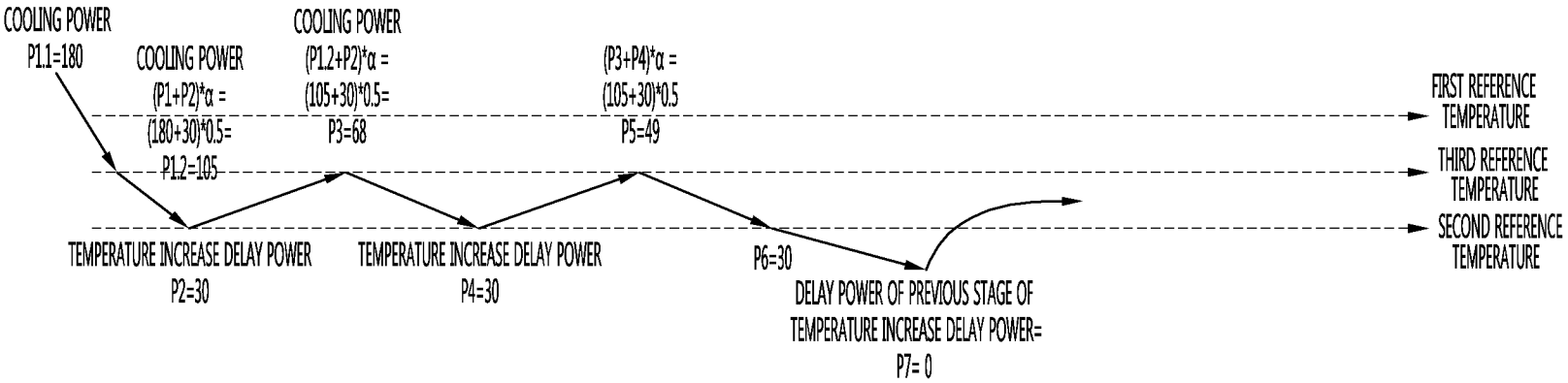

FIGS. 10 to 12 are graphs illustrating a variation in temperature of a storage room and a variation in power of a cool air supply means according to a method for controlling a refrigerator according to a third embodiment of the present invention.

The current embodiment is the same as the first embodiment except for a method for determining a cooling power. Thus, only characterized parts of the current embodiment will be principally described below, and descriptions of the same part as that of the first embodiment will be quoted from the first embodiment.

Referring to FIGS. 1 to 4 and 10, when the temperature of the storage room is sensed by the temperature sensor to perform the constant temperature control, and the sensed temperature of the storage room is equal to or greater than the first reference temperature, the control unit 50 determines the cooling power P1.1 of the cool air supply means to decrease the temperature of the storage room and allow the cool air supply means to operate at the determined cooling power P1.1 (see operation S3 of FIG. 2).

When the cool air supply means operates as the cooling power P1.1, the temperature of the storage room decreases, and thus, the control unit 50 may reduce the current cooling power when the temperature of the storage room reaches a predetermined temperature greater than the second reference temperature.

Here, the predetermined temperature may be a mean temperature of the first reference temperature and the second reference temperature or a target temperature of the storage room (the third reference temperature).

If the temperature of the storage room reaches a value equal to or below the second reference temperature while the cool air supply means is operating at the changed cooling power P1.2, the control unit 50 allows the cool air supply means to operate as the delay power P2.

Also, if the reference temperature of the storage room reaches a third reference temperature while the cool air supply means is operating with the delay power P2, the control unit 50 determines the cooling power P3.

In addition, all of the driving logic including the method for determining the cooling power and the delay power and the protection logics A and B are the same as those in the first embodiment.

As illustrated in FIG. 11, when the temperature of the storage room is equal to or greater than the first reference temperature, the control unit 50 determines the cooling power P1.1 of the cool air supply means to decrease the temperature of the storage room and allow the cool air supply means to operate at the determined cooling power P1.1 (see operation S3 of FIG. 2).

Even when the temperature of the storage room increases without decreasing and reaching the first reference temperature while the cool air supply means is operating with the determined cooling power P1.1, the control unit 50 may increase the current cooling power (same as the protection logic B described in the first embodiment).

Next, referring to FIG. 12, when the cool air supply means operates at the delay powers P2, P4, and P5, and the temperature of the storage room does not increase, but decreases below the second reference temperature, the control unit 50 may reduce the power of the cool air supply means or stop the operation (same as the protection logic A described in the first embodiment).

Figure 13:
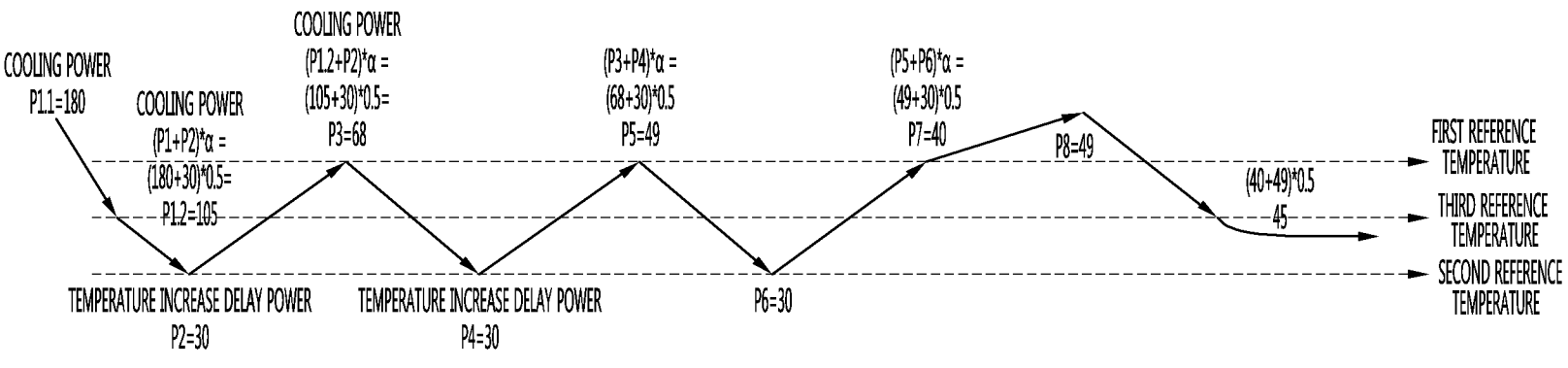
FIG. 13 is a view illustrating a variation in temperature of a storage room and a variation in power of a cool air supply means according to the method for controlling the refrigerator according to a fourth embodiment of the present invention.

FIG. 13 is a view illustrating a variation in temperature of a storage room and a variation in power of a cool air supply means according to the method for controlling the refrigerator according to the fourth embodiment of the present invention.

The current embodiment is the same as the first embodiment except for a method for determining a cooling power. Thus, only characterized parts of the current embodiment will be principally described below, and descriptions of the same part as that of the first embodiment will be quoted from the first embodiment.

Referring to FIGS. 1 to 13, when the temperature of the storage room is sensed by the temperature sensor to perform the constant temperature control, and the sensed temperature of the storage room is equal to or greater than the first reference temperature, the control unit 50 determines the cooling power P1.1 of the cool air supply means to decrease the temperature of the storage room and allow the cool air supply means to operate at the determined cooling power P1.1 (see operation S3 of FIG. 2).

When the cool air supply means operates as the cooling power P1.1, the temperature of the storage room decreases, and thus, the control unit 50 may reduce the current cooling power when the temperature of the storage room reaches the third reference temperature.

If the temperature of the storage room reaches a value equal to or below the second reference temperature while the cool air supply means is operating at the changed cooling power P1.2, the control unit 50 allows the cool air supply means to operate as the delay power P2.

While the cool air supply means is operating as the delay power P2, the control unit 50 determines whether the sensed temperature of the storage room reaches a value equal to or greater than the first reference temperature.

When it is determined that the sensed temperature of the storage room reaches a value that is equal to or above the first reference temperature, the control unit 50 determines cooling powers P3, P5, and P7 of the cool air supply means and allows the cool air supply means to operate at the determined cooling powers P3, P5, and P7.

In addition, all of the driving logic including the method for determining the cooling power and the delay power and the protection logics A and B are the same as those in the first embodiment.

Figure 14:
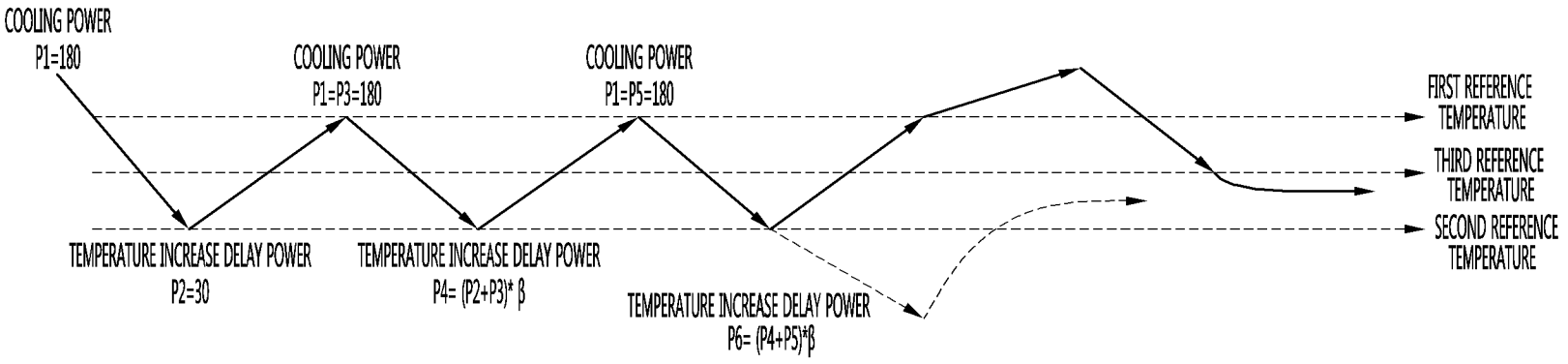
FIG. 14 is a view illustrating a variation in temperature of a storage room and a variation in power of a cool air supply means according to the method for controlling the refrigerator according to a fifth embodiment of the present invention.

FIG. 14 is a view illustrating a variation in temperature of a storage room and a variation in power of a cool air supply means according to the method for controlling the refrigerator according to a fifth embodiment of the present invention.

The current embodiment is the same as the first embodiment except for a method for determining a delay power. Thus, only characterized parts of the current embodiment will be principally described below, and descriptions of the same part as that of the first embodiment will be quoted from the first embodiment.

Although the embodiment from FIGS. 5 to 13 is not necessarily, in one aspect, the delay powers P2, P4, and P6 may be fixed values and may be understood as a method of adjusting the cooling powers P3, P5, and P7. On the other hand, in FIG. 14 is, not necessarily, but it may be understood that the cooling powers P3, P5 and P7 may be fixed values, and the delay powers P2, P4 and P6 may be controlled. Although only one embodiment in which the delay power is controlled is illustrated in FIG. 14, it is also possible to adjust the power for delay corresponding to each of the embodiments from FIGS. 5 to 13.

The method of FIGS. 5 to 13 and the method of FIG. 14 may be mixed to control both the cooling power and the delay power in a certain section or all sections.

Referring to FIG. 14, when the temperature of the storage room is sensed by the temperature sensor to perform the constant temperature control, and the sensed temperature of the storage room is equal to or greater than the first reference temperature, the control unit 50 determines the cooling power P1 of the cool air supply means to decrease the temperature of the storage room and allow the cool air supply means to operate at the determined cooling power P1.

When the cool air supply means operates as the cooling power P1, the temperature of the storage room decreases, and when the temperature of the storage room reaches a value equal to or below the second reference temperature, the control unit 50 allows the cool air supply means to operate as the delay power P2.

While the cool air supply means is operating as the delay power P2, the control unit 50 determines whether the sensed temperature T2 of the storage room reaches a value equal to or greater than the first reference temperature.

When it is determined that the sensed temperature of the storage room reaches a value that is equal to or above the first reference temperature, the control unit 50 determines cooling powers P3 and P5 of the cool air supply means and allows the cool air supply means to operate at the determined cooling powers P3, P5, and P7.

Here, the cooling powers P3 and P5 may be fixed powers that do not vary. For example, the cooling power may be determined as the maximum power or the power lower than the maximum power. Alternatively, the cooling powers P3 and P5 may be the cooling power P1 for the first time (power for initial cooling).

When the temperature of the storage room reaches a value equal to or less than the second reference temperature while the cool air supply means is operating as the cooling power P3 and P5, the control unit 50 determines the delay powers P4 and P6 of the cool air supply means and controls the cool air supply means to operate at the determined delay powers P4 and P6.

It is preferable that the delay powers P4 and P6 are determined to be larger than the delay power P2 of the previous stage.

The delay powers P4 and P6 are determined to be a value that is less than the cooling power of the previous stage and greater than or equal to the delay power P2 of the previous stage.

Each of the delaying powers P4 and P6 may be determined to be a value that is less than one of the cooling powers P1, P3 and P5 and is greater than that of one of the powers between the delay powers.

Alternatively, the delay powers P4 and P6 may be a power between the cooling power of the previous stage and the delay power P2 of the previous stage.

Although not limited, the respective delay powers P4 and P6 when the sensed temperature of the storage room reaches the third reference temperature may be determined as a value of the sum of one of the values for cooling P1, P3, and P5 driven in the preceding stage and the delay power driven in the previous stage×β. Here, β is greater than 0 and less than 1, may be set in advance in the memory, and may be set by the user or automatically changed.

The delay powers P4 and P6 when the sensed temperature of the storage room reaches a value equal to or less than the second reference temperature may be determined as a value (a mean power of cooling power and previously determined power for delay) of (the sum of the power for cooling and the power for the previously determined delay)×0.5, but is not limited thereto.

Figure 15:
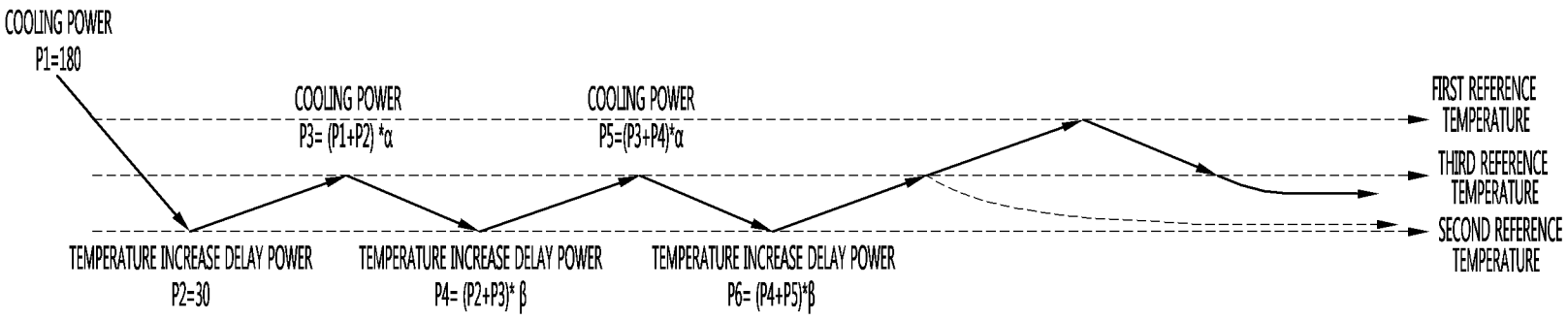
FIG. 15 is a view illustrating a variation in temperature of a storage room and a variation in power of a cool air supply means according to the method for controlling the refrigerator according to a sixth embodiment of the present invention.

FIG. 15 is a view illustrating a variation in temperature of a storage room and a variation in power of a cool air supply means according to the method for controlling the refrigerator according to a sixth embodiment of the present invention.

The current embodiment is the same as the first embodiment except for a method for determining a delay power. Thus, only characterized parts of the current embodiment will be principally described below, and descriptions of the same part as that of the first embodiment will be quoted from the first embodiment.

Compared with the embodiment of FIGS. 5 to 13 and the embodiment of FIG. 14, the embodiment of FIG. 15 is a system in which both the cooling powers P3, P5, and P7 and the delay powers P2, P4, and P6 are controlled. Although only one embodiment is shown in FIG. 15, it is applicable to all corresponding embodiments in FIGS. 5 to 14.

Referring to FIG. 15, when the temperature of the storage room is sensed by the temperature sensor to perform the constant temperature control, and the sensed temperature of the storage room is equal to or greater than the first reference temperature, the control unit 50 determines the cooling power P1 of the cool air supply means to decrease the temperature of the storage room and allow the cool air supply means to operate at the determined cooling power P1.

When the cool air supply means operates as the cooling power P1, the temperature of the storage room decreases, and when the temperature of the storage room reaches a value equal to or below the second reference temperature, the control unit 50 allows the cool air supply means to operate as the delay power P2.

While the cool air supply means is operating as the delay power P2, the control unit 50 determines whether the sensed temperature of the storage room reaches the third reference temperature.

When it is determined that the sensed temperature of the storage room reaches the third reference temperature, the control unit 50 determines cooling powers P3 and P5 of the cool air supply means and allows the cool air supply means to operate at the determined cooling powers P3 and P5.

The method for determining the cooling power is the same as that applied in the embodiment of FIGS. 5 to 13.

When the temperature of the storage room reaches a value equal to or less than the second reference temperature while the cool air supply means is operating as the cooling power P3 and P5, the control unit 50 determines the delay powers P4 and P6 of the cool air supply means and controls the cool air supply means to operate at the determined delay powers P4 and P6.

The method for determining the delay power is the same as that applied in the embodiment of FIG. 14.

Figure 16:
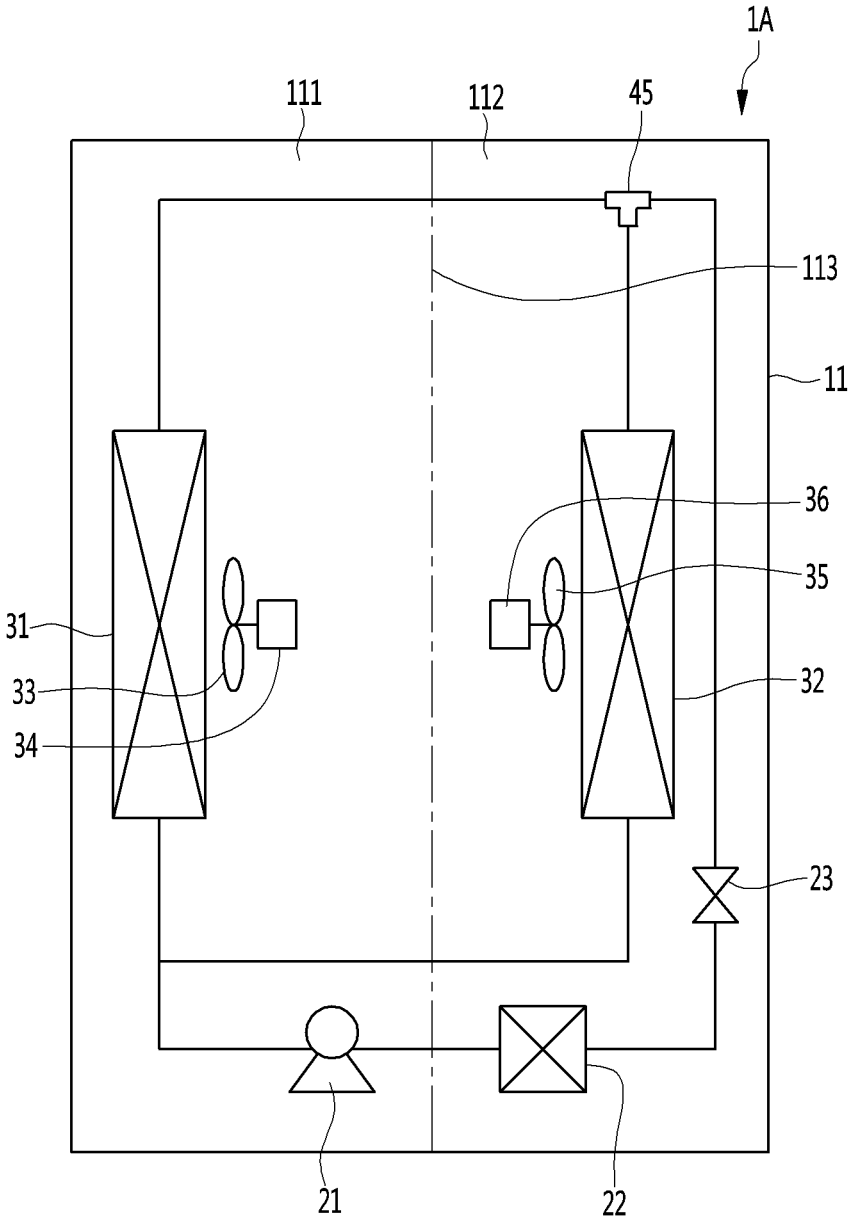
FIG. 16 is a schematic view illustrating a refrigerator according to a seventh embodiment of the present invention.

FIG. 16 is a schematic view illustrating a refrigerator according to a seventh embodiment of the present invention.

Referring to FIG. 16, unlike the refrigerator according to the first embodiment, a refrigerator 1A according to this embodiment may include an evaporator 31 for a freezing compartment and an evaporator 32 for a refrigerating compartment.

Also, the refrigerator 1A includes a freezing compartment fan 33, a first fan motor 34 for rotating the freezing compartment fan 33, a refrigerating compartment fan 35, a second fan 36 for rotating the refrigerating compartment fan 35.

Also, the refrigerator 1A may include a compressor 21, a condenser 22, an expansion member 23, and a valve 45 for allowing a refrigerant passing through the expansion member 23 to flow one of the evaporator 31 for the freezing compartment and the evaporator 32 for the refrigerating compartment.

In the present embodiment, the constant temperature control of the freezing compartment 111 is enabled by the control of the compressor 21 and the first fan motor 34, and the constant temperature control of the refrigerating compartment 112 is performed by the compressor 21 and a second fan motor 34. In addition, it is possible to control the constant temperature of the refrigerating compartment 112 by controlling an opening angle of the valve 45.

Therefore, in the case of the refrigerator in this embodiment, the control method for the constant temperature mentioned in the first to sixth embodiments can be applied as it is.

Figure 17:
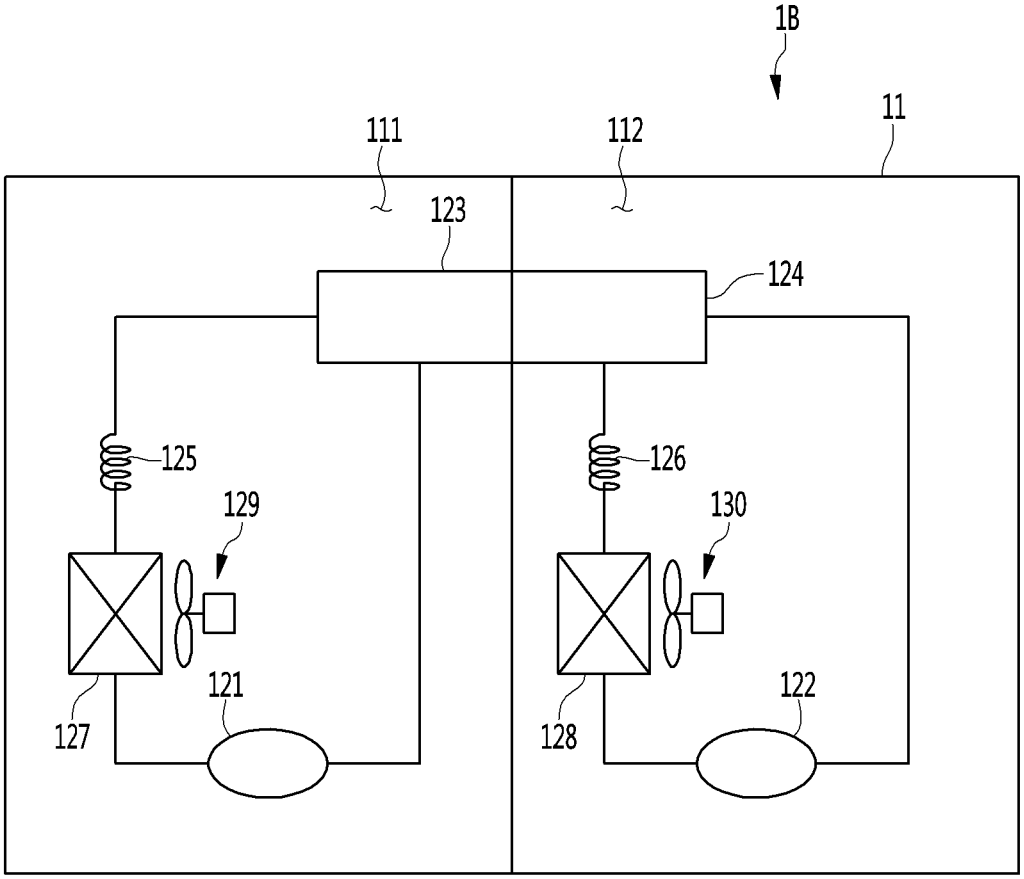
FIG. 17 is a schematic view illustrating a refrigerator according to an eighth embodiment of the present invention.

FIG. 17 is a schematic view illustrating a refrigerator according to an eighth embodiment of the present invention.

Referring to FIG. 17, unlike the refrigerator according to the first embodiment, a refrigerator 1B according to this embodiment may include a cabinet 11 provided with a freezing compartment 111 and a refrigerating compartment 112, an evaporator 127 for the freezing compartment, an evaporator 128 for the refrigerating compartment, and a compressor 121 for the freezing compartment.

Also, the refrigerator 1B includes a compressor 122 for the refrigerating compartment, condensers 123 and 124, an expansion member 125 for the freezing compartment, an expansion member 126 for the refrigerating compartment, a fan motor assembly 129 for the freezing compartment, and a fan motor assembly 130 for the refrigerating compartment.

In the present invention, the freezing compartment 111 and the refrigerating compartment 112 may be independently cooled by separate compressors and evaporators.

However, the condensers 123 and 124 may constitute one heat exchanger and also be divided into two parts through which the refrigerant flows. That is, the refrigerant discharged from the compressor 121 for the freezing compartment may flow through a first part 123 of the condensers 123 and 124, and the refrigerant discharged from the compressor 122 for the refrigerating compartment may flow through a second part 124 of the condensers 123 and 124.

The control method for the constant temperature described in the first to sixth embodiments can be applied as it is, except that the freezing compartment 111 and the refrigerating compartment 112 are independently cooled.

That is, in the present embodiment, the constant temperature control of the freezing compartment 111 may be performed by controlling the freezing compartment compressor 121 and the freezing compartment fan motor assembly 129, and the constant temperature control of the refrigerating compartment 112 is possible by controlling the refrigerating compartment compressor 122 and the refrigerating compartment fan motor assembly 130.

The invention claimed is:

1. A method for controlling a refrigerator, the method comprising:

sensing a temperature of a storage compartment;

operating a cool air supply at a first cooling power in response to the sensed temperature of the storage compartment being equal to or greater than a first reference temperature;

in response to the sensed temperature of the storage compartment becoming equal to or less than a second reference temperature that is less than the first reference temperature while the cool air supply is operating at the first cooling power, operating the cool air supply at a second cooling power that is less than the first cooling power;

in response to the sensed temperature of the storage compartment being less than the first reference temperature and greater than the second reference temperature while the cool air supply is operating t the first cooling power, operating the cool air supply at tai first cooling power;

in response to the temperature of the storage compartment becoming equal to a third reference temperature that is less than the first reference temperature while the cool air supply is operating at the second cooling power, adjusting the first cooling power of the cool air supply, and operating the cool air supply at the adjusted first cooling power; and in response to the temperature of the storage compartment being less than the third reference temperature and greater than the second reference temperature while the cool air supply is operating at the second cooling power, operating the cool air supply at the second cooling power.

2. The method of claim 1, wherein the adjusted first cooling power of the cool air supply is determined based on the first cooling power and the second cooling power.

3. The method of claim 2, wherein the adjusted first cooling power of the cool air supply is determined as (a sum of the first cooling power and the second cooling power)×α, and wherein α is greater than 0 and less than 1.

4. The method of claim 2, wherein the adjusted first cooling power of the cool air supply is determined as a value that is greater than the second cooling power and equal to or less than the first cooling power.

5. The method of claim 1, further comprising:

increasing the adjusted first cooling power to be greater than a first cooling power that was previously determined, and operating the cold air supply at the increased adjusted first cooling power in response to the temperature of the storage compartment increasing while the cool air supply operates at the first cooling power.

6. The method of claim 1, wherein the third reference temperature is a target temperature of the storage compartment or a mean of the first reference temperature and the second reference temperature.

7. The method of claim 1, wherein the second cooling power is a constant cooling power regardless of the temperature of the storage compartment.

8. The method of claim 1, wherein the second cooling power is greater than a minimum cooling power of the cool air supply.

9. The method of claim 1, further comprising adjusting the second cooling power of the cool air supply in response to the temperature of the storage compartment being equal to or less than the second reference temperature; and operating the cool air supply at the adjusted second cooling power.

10. The method of claim 9, wherein the adjusted second cooling power of the cool air supply is determined based on the first cooling power and the second cooling power.

11. The method of claim 10, wherein the adjusted second cooling power of the cool air supply is determined as (a sum of the first cooling power and the second cooling power)×β, and wherein β is greater than 0 and less than 1.

12. A method for controlling a refrigerator, the method comprising:

sensing a temperature of a storage compartment;

operating a cool air supply at a first cooling power in response to the sensed temperature of the storage compartment being equal to or greater than a first reference temperature;

in response to the sensed temperature of the storage compartment becoming equal to or less than a second reference temperature that is less than the first reference temperature while the cool air supply is operating at the first cooling power, operating the cool air supply at a second cooling power that is less than the first cooling power;

in response to the sensed temperature of the storage compartment being less than the first reference temperature and greater than the second reference temperature while the cool air supply is operating at the first cooling power, operating the cool air supply at the first cooling power;

in response to the temperature of the storage compartment becoming equal to the first reference temperature while the cool air supply is operating at the second cooling power, adjusting the first cooling power of the cool air supply, and operating the cool air supply at the adjusted first cooling power; and in response to the temperature of the storage compartment being less than the first reference temperature and greater than the second reference temperature while the cool air supply is operating at the second cooling power, operating the cool air supply at the second cooling power.

13. The method of claim 12, wherein the adjusted first cooling power of the cool air supply is determined based on the first cooling power and the second cooling power.

14. The method of claim 13, wherein the adjusted first cooling power of the cool air supply is determined as (a sum of the first cooling power which is determined previously and the second cooling power)×α, and wherein α is greater than 0 and less than 1.

15. The method of claim 13, wherein the adjusted first cooling power of the cool air supply is greater than the second cooling power and equal to or less than the first cooling power.

16. The method of claim 12, wherein the second cooling power is a constant cooling power regardless of the temperature of the storage compartment, or the second cooling power is greater than a minimum cooling power of the cool air supply.

17. A method for controlling a refrigerator, the method comprising:

sensing a temperature of a storage compartment;

operating a cool air supply at a first cooling power in response to the sensed temperature of the storage compartment being equal to or greater than a first reference temperature;

in response to the sensed temperature of the storage compartment becoming equal to or less than a second reference temperature that is less than the first reference temperature while the cool air supply is operating at the first cooling power, operating the cool air supply at a second cooling power that is less than the first cooling power;

in response to the sensed temperature of the storage compartment being less than the first reference temperature and greater than the second reference temperature while the cool air supply is operating at the first cooling power, operating the cool air supply at the first cooling power;

operating the cool air supply at the first cooling power in response to the sensed temperature of the storage compartment becoming equal to or greater than the first reference temperature while the cool air supply is operating at the second cooling power;

in response to the temperature of the storage compartment being less than the first reference temperature and greater than the second reference temperature while the cool air supply is operating at the second cooling power, operating the cool air supply at the second cooling power;

adjusting the second cooling power of the cool air supply in response to the temperature of the storage compartment becoming equal to or less than the second reference temperature while the cool air supply is operating at the first cooling power, and operating the cool air supply at the adjusted second cooling power; and in response to the temperature of the storage compartment becoming less than the first reference temperature and greater than the second reference temperature while the cool air supply is operating at the first cooling power, operating the cool air supply at the first cooling power.

18. The method of claim 17, wherein the adjusted second cooling power of the cool air supply is determined based on the first cooling power and the second cooling power.

19. The method of claim 18, wherein the adjusted second cooling power of the cool air supply is determined as (a sum of the first cooling power and the second cooling power)×β, and wherein β is greater than 0 and less than 1.

20. The method of claim 18, wherein the adjusted second cooling power of the cool air supply is determined as a value that is less than the first cooling power and is equal to or greater than the second cooling power.

* * * * *